US008512924B2

(12) United States Patent
Kami et al.

(10) Patent No.: US 8,512,924 B2
(45) Date of Patent: Aug. 20, 2013

(54) ELECTROPHOTOGRAPHIC PHOTORECEPTOR, AND IMAGE FORMING APPARATUS AND PROCESS CARTRIDGE USING THE PHOTORECEPTOR

(75) Inventors: Hidetoshi Kami, Shizuoka-ken (JP); Kazuhiro Egawa, Shizuoka-ken (JP); Yukio Fujiwara, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 291 days.

(21) Appl. No.: 13/019,684

(22) Filed: Feb. 2, 2011

(65) Prior Publication Data

US 2011/0200924 A1 Aug. 18, 2011

(30) Foreign Application Priority Data

Feb. 17, 2010 (JP) ..... 2010-032002

(51) Int. Cl.
*G03G 5/14* (2006.01)

(52) U.S. Cl.
USPC ..... 430/66; 430/58.7; 430/56; 430/119.71; 399/111; 399/159

(58) Field of Classification Search
USPC ..... 430/56, 66, 58.7; 399/159, 111
See application file for complete search history.

(56) References Cited

U.S. PATENT DOCUMENTS

| | | | | |
|---|---|---|---|---|
| 4,772,525 | A | 9/1988 | Badesha et al. | |
| 6,221,552 | B1 * | 4/2001 | Street et al. | 430/130 |
| 7,226,711 | B2 * | 6/2007 | Amamiya et al. | 430/58.7 |
| 7,534,534 | B2 | 5/2009 | Nakata et al. | |
| 7,718,331 | B2 * | 5/2010 | Uematsu et al. | 430/56 |
| 8,293,439 | B2 * | 10/2012 | Fujiwara et al. | 430/66 |
| 2005/0255393 | A1 * | 11/2005 | Nakata et al. | 430/56 |
| 2006/0019185 | A1 | 1/2006 | Amamiya et al. | |
| 2008/0227008 | A1 * | 9/2008 | Kami et al. | 430/66 |

FOREIGN PATENT DOCUMENTS

| | | |
|---|---|---|
| JP | 57-78402 | 5/1982 |
| JP | 6-35220 | 2/1994 |
| JP | 7-104497 | 4/1995 |
| JP | 7-292095 | 11/1995 |
| JP | 2509292 | 4/1996 |
| JP | 8-248663 | 9/1996 |
| JP | 9-236938 | 9/1997 |
| JP | 3040540 | 3/2000 |
| JP | 2000-162881 | 6/2000 |
| JP | 2000-171990 | 6/2000 |
| JP | 2001-265014 | 9/2001 |
| JP | 2001-289630 | 10/2001 |
| JP | 2002-82468 | 3/2002 |

(Continued)

*Primary Examiner* — Christopher Rodee
(74) *Attorney, Agent, or Firm* — Cooper & Dunham LLP

(57) ABSTRACT

An electrophotographic photoreceptor, including an electroconductive substrate; a photosensitive layer; a crosslinked surface layer comprising α-alumina and tin oxide, wherein a first one-dimensional data array obtained from measuring a concavo-convex shape of the surface of the photoreceptor is subjected to a wavelet conversion to be separated into 6 frequency components, the one-dimensional data array of the lowest frequency component is further thinned so as to have 1/40 data arrays to obtain a second one-dimensional data array, the second one-dimensional data array is further subjected to the wavelet conversion to be separated into additional 6 frequency components, and wherein when relationships between respective arithmetic average roughness (WRa) (y-axis) of the 12 frequency components and the frequency components (x-axis) are graphed, at least WRa (214 to 551 μm) and WRa (26 to 106 μm) have a folding point or a maximum point.

6 Claims, 21 Drawing Sheets

(56) References Cited

FOREIGN PATENT DOCUMENTS

| | | |
|---|---|---|
| JP | 2002-196645 | 7/2002 |
| JP | 2002-251029 | 9/2002 |
| JP | 2002-296994 | 10/2002 |
| JP | 2002-341572 | 11/2002 |
| JP | 2003-131537 | 5/2003 |
| JP | 2003-241408 | 8/2003 |
| JP | 2003-270840 | 9/2003 |
| JP | 2004-54001 | 2/2004 |
| JP | 2004-61359 | 2/2004 |
| JP | 2004-258588 | 9/2004 |
| JP | 2005-345791 | 12/2005 |
| JP | 2006-53576 | 2/2006 |
| JP | 2006-53577 | 2/2006 |
| JP | 2006-79102 | 3/2006 |
| JP | 2006-163302 | 6/2006 |
| JP | 3878425 | 11/2006 |
| JP | 3878427 | 11/2006 |
| JP | 3878428 | 11/2006 |
| JP | 2007-79244 | 3/2007 |
| JP | 2007-86319 | 4/2007 |
| JP | 3943476 | 4/2007 |
| JP | 4003914 | 8/2007 |
| JP | 4011790 | 9/2007 |
| JP | 2007-292772 | 11/2007 |
| JP | 4110116 | 4/2008 |
| JP | 4136567 | 6/2008 |
| JP | 2008-233206 | 10/2008 |
| JP | 4194973 | 10/2008 |
| JP | 4400704 | 11/2009 |
| WO | WO2005/093518 A1 | 10/2005 |
| WO | WO2005/093520 A1 | 10/2005 |

* cited by examiner

ELECTROPHOTOGRAPHIC PHOTORECEPTOR, AND IMAGE FORMING APPARATUS AND PROCESS CARTRIDGE USING THE PHOTORECEPTOR

BACKGROUND OF THE INVENTION

1. Field of the Invention

The present invention relates to an electrophotographic photoreceptor, and to a process cartridge and an image forming apparatus using the photoreceptor, which are applied to copiers, facsimiles, laser printers, direct digital platemakers, etc.

2. Description of the Related Art

At one time, photoreceptors including inorganic materials such as selenium, zinc oxide, and cadmium sulfide were the dominant type of electrophotographic photoreceptors used in electrophotographic image forming apparatuses such as copiers and laser printers. However, at present, almost all electrophotographic photoreceptors are organic photoreceptors, which are more advantageous than the inorganic photoreceptors in terms of load reduction on the global environment, cost reduction, and design freedom. Further, as the importance of production in consideration of global environmental protection increases, the organic photoreceptor is required to change from a disposable item to a durable machine component.

In order to make the organic photoreceptors more durable, various attempts have been made. At present, forming a crosslinked surface layer as disclosed in Japanese published unexamined application No. 2000-66424, and forming a sol-gel cured layer on the surface of a photoreceptor as disclosed in Japanese published unexamined application No. 2000-171990, have generated high expectations. The former has an advantage of scarcely having a crack even when including a charge transport component and increasing yield when produced. In particular, a radical polymerizable acrylic resin can prepare a durable and high-sensitivity photoreceptor. These methods are thought reasonable because they form a crosslinked layer with plural chemical bonds, which is not quickly abraded even when the chemical bonds are partly cut with stress.

The above-mentioned photoreceptors have better durability when including a high-hardness filler. Since coating materials for the surface layer are mostly monomeric components, the coating materials have low viscosity and the high-hardness filler occasionally has a problem with dispersion stability. When the filler does not have good dispersion stability, the photoreceptor has an awkward surface and adversely influences cleanability of a toner. Therefore, the filler needs to increase its dispersion stability in coating materials for the crosslinked surface layer, but this aspect has not been studied enough.

A polymerized (spherical) toner is mostly used as a developing toner for electrophotography because of having advantages of being environmentally friendly when prepared and producing higher quality images.

The polymerized (spherical) toner is a spherical toner without any angulation, and is prepared by chemical preparation methods such as suspension polymerization, emulsion aggregation polymerization, ester elongation polymerization, and solution suspension. The polymerized toners have different shapes according to their preparation methods, and the polymerized toners used in image forming apparatuses have shapes slightly different from a complete sphere. The polymerized toner typically has an average circularity of from 0.95 to 0.99 and shapes factors SF-1 and SF-2 of from 110 to 140. A toner is a complete sphere when having an average circularity of 1.0 and shapes factors SF-1 and SF-2 of 100.

Having a uniform shape, the polymerized toner is likely to hold a uniform charge. Further, the polymerized toner easily includes a wax (5 to 10%). Therefore, the polymerized toner has good developability and transferability, and produces images having good sharpness, image resolution, and tone reproducibility because of scarcely spreading out of an electrostatic latent image. In addition, the polymerized toner has many advantages such as no need for an oil when transferred. However, the polymerized toner has poor cleanability and needs to have more external additives, resulting in occasional killifish-shaped filming on a photoreceptor. Many studies have been undertaken to solve this problem and many suggestions are made in patent documents, etc.

A photoreceptor is typically required to have a low friction coefficient and to keep this even when repeatedly used, such that a polymerized toner has cleanability. For example, Japan Hardcopy Fall Meeting, 24-27, 2001 written by Nobuo Momotake, Akihisa Maruyama, Satoshi Shigesaki, and Hiroe Okuyama, discloses improving cleanability of a polymerized toner by applying a solid lubricant such as zinc stearate onto the surface of a photoreceptor.

When a solid lubricant such as zinc stearate is externally applied to a highly-durable electrophotographic photoreceptor on which the crosslinked radical polymerizable acrylic resin layer is formed, occasionally the surface of the photoreceptor does not accept the solid lubricant. Many photoreceptors have smooth surfaces, and it is thought that this poor acceptability is due to the surface smoothness of a photoreceptor. Japanese published unexamined patent application No. 2007-79244 discloses a method of roughening the surface of a photoreceptor to stably apply a lubricant thereto. Specifically, the surface roughness (Rz-JIS '94) thereof is preferably from 0.4 to 1.0 μm, and a filler is preferably added into a surface layer thereof to maintain a specific surface roughness.

However, the photoreceptors have various shapes of surface roughness even when having the same Rz. For example, even photoreceptors having extremely different distances between concavities and convexities have the same Rz. Even photoreceptors having the same Rz occasionally have rank orders of zinc stearate acceptability. Electrophotographic photoreceptors need special conditions besides Rz to increase acceptability of zinc stearate. The surface roughness of an electrophotographic photoreceptor is an important property, and has been measured by a method specified in JIS B0601 in many cases.

Methods measuring roughness includes a method of measuring arithmetic average roughness, a method of measuring a maximum height (Rmax), a method of measuring ten-point average roughness, etc. However, values measured by these methods run into difficulties when concavities and convexities are considerably distant from each other in a measured range. However, good methods of evaluating roughness have not been available, and parameters showing roughness are being studied as follows.

Japanese published unexamined patent application No. 7-104497 specifies a partition width X based on an average line 2 on a profile curve (1) obtained by measuring a surface profile with a surface roughness measurer to evaluate the surface profile by the number of peaks formed of a pair of peaks (4) and troughs adjacent to each other over the partition width at a unit length (L). An organic photoreceptor is prepared using a substrate prepared under the following conditions.

Partition width X: 20 μm

Unit length L: 1 cm

The number of peaks (4): 100 or less

Japanese published unexamined patent application No. 2002-196645 discloses, for the purpose of producing high-quality images, a cleaning roller applied with a bias voltage separating a charged toner from a photoreceptor located on an upstream side of a cleaning blade, and the photoreceptor has an average ten-point surface roughness Rz of from 0.1 to 2.5 μm.

Japanese published unexamined patent application No. 2006-163302 discloses a method of satisfying the following relations:

$$\Delta T > Rz$$

$$0\ \text{nm} < \Delta T + Rz < 5\ \text{nm}$$

wherein ΔT represents a layer abrasion amount of an electrophotographic photoreceptor per 1 k cycle and Rz represents a surface roughness.

Japanese published unexamined patent application No. 2007-86319 discloses an electrophotographic photoreceptor, the surface of a photosensitive layer of which is roughened. In addition, the roughened surface has a standard deviation of glossiness of 4 or less when measured.

Japanese Patent No. 3040540 discloses a system including a blade, a toner composition, and an unused image forming member including a surface forming a latent image with the toner composition. The surface has a roughness defined by the following formulae:

$$R/ann4 > KB(1-\sigma 2)/32\ \pi Et2af$$

and $$R/ann2 < \sqrt{3}/8\pi 2\cdot(1+\mu 2)/\mu\cdot KB/\Gamma\cdot t/af\cdot\theta$$

wherein R represents an average altitude of convexities on the surface, ann represents half the closest adjacent distance among the convexities, KB represents a volume elastic modulus, σ represents a Poisson ratio of the toner composition, E represents a Young's modulus, t represents an average thickness of flat particles in the toner composition, of represents an average radius of the flat particles, μ represents an average between a toner-blade friction coefficient and a toner-surface friction coefficient, Γ represents a Dupre's work, and θ represents a blade tip angle.

Japanese Patent No. 3938209 discloses a cylindrical electrophotographic photoreceptor including a cylindrical substrate and an organic photosensitive layer formed thereon. In claim 1, the electrophotographic photoreceptor has plural dimple-shaped concavities on its circumferential surface; a ten-point average roughness measured in a circumferential direction of the surface thereof. Rzjis (A) is from 0.3 to 2.5 μm; a ten-point average roughness measured in a bus direction of the surface thereof. Rzjis (B) is from 0.3 to 2.5 μm; an average distance RSm (C) among convexities and concavities, measured in a circumferential direction of the surface thereof, is from 5 to 120 μm; an average distance RSm (D) among convexities and concavities, measured in a bus direction of the surface thereof, is from 5 to 120 μm; a ratio (D/C) of the average distance RSm (D) among convexities and concavities to the average distance RSm (D) among convexities and concavities is from 0.5 to 1.5; and 5 to 50 of the dimple-shaped concavities having a maximum diameter of from 1 to 50 μm and a depth of from 0.1 to 2.5 μm in an area of 10,000 $\mu m^2$ on its circumferential surface. Further, in claim 2, the Rzjis (A) is limited to 0.4 to 2.0 μm; the Rzjis (B) is limited to 0.4 to 2.0 μm; the RSm (C) is limited to 10 to 100 μm; the RSm (D) is limited to 10 to 100 μm; and the ratio (D/C) is limited to 0.8 to 1.2. In claim 3, the electrophotographic photoreceptor has a maximum height Rp (F) of the circumferential surface not greater than 0.6 μm, and a ratio (E/F) of a maximum depth Rv (E) of the circumferential surface to the maximum height Rp (F) not less than 1.2.

Japanese Patent No. 3938210 discloses an electrophotographic photoreceptor including a substrate and an organic photosensitive layer formed thereon. The electrophotographic photoreceptor has plural dimple-shaped concavities on a surface layer, and 5 to 50 of the dimple-shaped concavities having a maximum diameter of from 1 to 50 μm, and a depth not less than 0.1 μm and a volume not less than 1 $\mu m^3$ in an area of 100 $\mu m^2$ on the surface layer. In addition, plural concavities corresponding to the dimple-shaped concavities on the surface layer are formed on an interface between the surface layer and a layer just under the surface layer.

Japanese published unexamined patent application No. 2005-345788 discloses an image forming apparatus including plural image bearers each formed of an electroconductive substrate and a photosensitive layer thereon, forming an electrostatic latent image when irradiated; plural image developers for the plural image bearers, each developing the electrostatic latent image with a developer; and plural cleaners for the plural image bearers, each scraping the surface of the image bearer to remove the developer. At least a pair of the image developers contain developers having the same hue and different brightness. According to the brightness, ten-point average roughness Rz of the image bearer in the initial state is controlled.

Japanese published unexamined patent application No. 2004-258588 discloses an image forming apparatus using an electrophotographic photoreceptor having a ten-point average roughness Rz of from 0.1 to 1.5 μm or a maximum height Rmax not greater than 2.5 μm, a JIS-S hardness of from 70 to 80, and a friction resistance Rf less than 200 gf and greater than 45 gf which is a tension load measured by applying a load of 100 g on a flat belt made of polyurethane having a width of 5 mm, a length of 325 mm, a thickness of 2 mm and a weight of 4.58 g at a contact length of 3 mm and a contact area of 15 $mm^2$ in a circumferential direction.

Japanese published unexamined patent application No. 2004-54001 discloses an image forming method including a process of developing a latent image formed on an electrophotographic photoreceptor with a developer to form a toner image; a first transfer process of transferring the toner image onto an intermediate transferer; a second transfer process of transferring the toner image onto a recording material; and a cleaning process of removing a residual toner on the electrophotographic photoreceptor after transferring the toner image onto the recording material. The electrophotographic photoreceptor has a surface roughness Ra of from 0.02 to 0.1 μm, the intermediate transferer has a surface roughness Rz of from 0.4 to 2.0 μm, and a surface energy reducer is applied to the surface of the electrophotographic photoreceptor.

Japanese published unexamined patent application No. 2003-270840 discloses an organic photoreceptor having a cycle average of surface concavities and convexities ten times or more of a volume-average particle diameter of a toner.

Japanese published unexamined patent application No. 2003-241408 discloses an image forming apparatus including an electrophotographic photoreceptor rotating at a peripheral speed not less than 200 mm/sec and a cleaner. The electrophotographic photoreceptor includes an electroconductive substrate, a photosensitive layer on the substrate, and a surface protection layer on the photosensitive layer. The surface protection layer includes a fluorine-containing particulate resin in an amount of from 35.0 to 45.0% by weight based on total weight of the protection layer, and has a ten-point average roughness of from 0.1 to 5.0 μm, a surface hardness of from 0.1 to 10.0 when measured by TABER abrasion test method, and a surface friction coefficient of from 0.1 to 0.7. The cleaner is an elastic rubber blade having a linear pressure of from 0.294 to 0.441 N/cm against the photoreceptor, a tensile elasticity (Young's modulus) of from 784 to 980 $N/cm^2$, a repulsive elasticity of from 35 to 55%, and includes fluorine-containing particulate resin at the surface. In addition, the image forming apparatus uses a toner having a glass transition temperature (Tg) of from 40 to 55° C.

Japanese published unexamined patent application No. 2003-131537 discloses an image forming method using an image former having the following relationship:

$$d/t \times 0.01 \leq Ra 0.5$$

wherein d/t represents a flatness of a toner (d is a volume-average particle diameter of the toner and t is a thickness thereof) and Ra (μm) represents an arithmetic average roughness of the image former.

Japanese published unexamined patent applications Nos. 2002-296994 and 2002-258705 disclose an image forming apparatus including an image bearer having convexities and concavities smaller than a volume-average particle diameter of spherized toner on its surface.

Japanese published unexamined patent application No. 2002-82468 discloses an image forming apparatus including an electrophotographic photoreceptor rotating at a peripheral speed not less than 200 mm/sec and a cleaner. The electrophotographic photoreceptor includes an electroconductive substrate, a photosensitive layer on the substrate, and a surface protection layer on the photosensitive layer. The surface protection layer includes a fluorine-containing particulate resin in an amount of from 15.0 to 40.0% by weight based on total weight of the protection layer, and has a ten-point average roughness of from 0.1 to 5.0 μm, a surface hardness of from 0.1 to 20.0 when measured by TABER abrasion test method, and a surface friction coefficient of from 0.001 to 1.2.

Japanese published unexamined patent applications Nos. 2001-265014, 2001-289630, 2002-251029, 2002-296822, 2002-296823, 2002-341572, 2002-296824, 2006-53576, 2006-53577 and 2006-79102 disclose a method of evaluating surface profile using Fourier transform. The Fourier transform can grasp variations frequently appearing in signals as its frequency distribution, but cannot effectively grasp variations not frequently appearing. Further, where the variation is made is not known.

Japanese published unexamined patent application No. 2004-117454 discloses a method of determining a profile curve defined in JIS B0602 from a random point on the surface of a substrate at a length of 100 μm in an axial direction, measuring a position of the profile curve in a longitudinal axial direction at an equally-spaced position on a horizontal direction, determining a dispersion defined in JIS 28101 of the position, and determining a measurement value selected from Ra, Rz and Ry defined in JIS B0601 to evaluate a surface roughness of the substrate.

However, none of the above surface roughness measurement methods can completely evaluate cleanability of image forming apparatuses using a toner having a small particle diameter or a polymerization toner.

Namely, conventional methods using terms such as Ra, Rmax and Rz cannot precisely measure the surface roughness.

Therefore, conventionally, a record chart of surface roughness/profile measurers is saved and the roughness is determined from a cut waveform recorded in the record chart. However, a trend of the record chart needs reading out and skill.

Japanese published unexamined patent application No. 2007-79244 has the following problem. In its Examples, particulate alumina is used. The particulate alumina needs specific film-forming conditions because of having unstable filler dispersibility in coating materials. Particulate polymethylsilsesquioxane also used therein cannot be said to have sufficient acceptability for lubricants because it is thought that a photoreceptor including polymethylsilsesquioxane at its surface has large concavities and convexities and cannot sufficiently bear a solid lubricant.

A coating material for crosslinked surface layer has low viscosity because of mainly including monomeric components. In contrast, since silicon-containing particulate materials such as silica and particulate silicone resins have high dispersion stability in a coating material for crosslinked surface layer, they are more advantageously used among various fillers. However, it was difficult to actually use the silicon-containing particulate materials in the following points. Japanese published unexamined patent application No. 2005-99688 discloses an example using a silicon-containing particulate material in Example 2 mentioned from [0162]. However, even in this Example, the photoreceptor does not have sufficient acceptability for a solid lubricant. It is thought that the photoreceptor has large concavities and convexities on its surface and cannot sufficiently bear a solid lubricant. An additional new technology is needed.

Japanese published unexamined patent application No. 08-248663 discloses dispersing an inorganic particulate material (hydrophobized silica) having an average particle diameter of from 0.05 to 0.5 μm in a photosensitive layer having a surface roughness of from 0.1 to 0.5 μm at a depth of from 0.05 to 15 μm, which is formed on an electroconductive substrate having a surface roughness of from 0.01 to 2 μm.

The dispersed hydrophobized particulate silica increases durability of the photoreceptor and prevents deterioration of image resolution (image distortion) caused by adherence of contaminants such as corona products. The hydrophobized inorganic particulate material repels water (a contact angle thereof is large), but the adherence of corona products cannot be prevented. As disclosed in Japanese published unexamined patent application No. 2004-138643, alumina is used as a filler to avoid image distortion. However, as mentioned above, alumina is difficult to include as is in a crosslinked surface layer.

In an image forming apparatus externally adding a solid lubricant to the surface of a photoreceptor, the lubricant acceptability thereof influences an abrasion speed thereof and cleanability of a toner, impacting printed image quality. At present, technologies sufficiently improving the lubricant acceptability of a photoreceptor having a highly-durable crosslinked surface layer are not yet available.

Japanese published unexamined patent applications Nos. 2004-61359 and 2007-292772 disclose a surface roughness measurement method of sensitively and precisely grasping a local transformation and variation of the surface of an image forming member such as substrates of electrophotographic photoreceptors, in which a profile curve defined in JIS B0601 of the surface of the image forming member is determined, and a multiple image resolution analysis such as wavelet conversions of lines of positional data in a surface roughness direction at equally-spaced positions on the profile curve is performed.

Because of these reasons, a need exists for improvement of acceptability of a highly-durable electrophotographic photoreceptor having a crosslinked surface layer for a lubricant.

SUMMARY OF THE INVENTION

Accordingly, an object of the present invention is to provide an electrophotographic photoreceptor having good acceptability for a solid lubricant.

Another object of the present invention is to provide a process cartridge using the photoreceptor.

A further object of the present invention is to provide an image forming apparatus using the photoreceptor.

To achieve such objects, the present invention contemplates the provision of an electrophotographic photoreceptor, comprising:

an electroconductive substrate;

a photosensitive layer overlying the substrate;

a crosslinked surface layer comprising α-alumina and tin oxide, overlying the photosensitive layer, wherein a first one-dimensional data array obtained from measuring a concavo-convex shape of the surface of the photoreceptor with a surface roughness/profile shape measurer is subjected to a first multiple image resolution analysis in which a wavelet conversion is made to the first one-dimensional data array to be separated into 6 frequency components HHH, HHL, HMH, HML, HLH and HLL having single-cycle lengths of a concavity and a convexity of from 0 to 3, 1 to 6, 2 to 13, 4 to 25, 10 to 0 and 24 to 99 μm, respectively, the one-dimensional data array of the frequency component HLL is further thinned so as to have 1/40 data arrays to obtain a second one-dimensional data array, the second one-dimensional data array is further subjected to a second multiple image resolution analysis in which the wavelet conversion is made to the second one-dimensional data array to be separated into additional 6 frequency components LHH, LHL, LMH, LML, LLH and LLL having single-cycle lengths of a concavity and a convexity of from 26 to 106, 53 to 183, 106 to 318, 214 to 551, 431 to 954 and 867 to 1,654 μm, respectively, and wherein when relationships between respective arithmetic average roughness (WRa) (y-axis) of the 12 frequency components and the frequency components (x-axis) are graphed, at least WRa (LML) and WRa (LHH) have a folding point or a maximum point.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
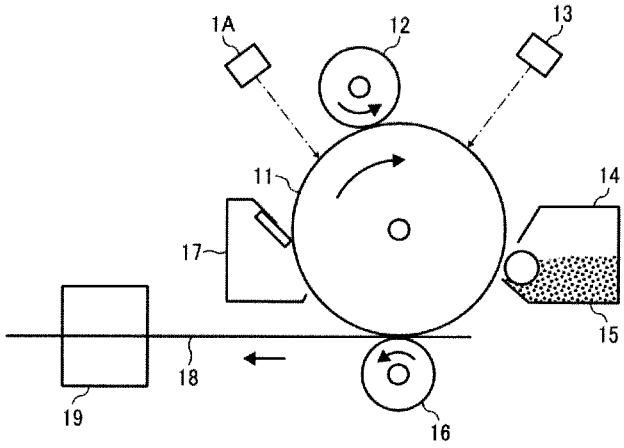
FIG. 1 is a schematic cross-sectional view illustrating an embodiment of the image forming apparatus of present invention.

Generally, the present invention provides an electrophotographic photoreceptor having good acceptability for a solid lubricant.

More particularly, the present invention relates to an electrophotographic photoreceptor, comprising:

an electroconductive substrate;

a photosensitive layer overlying the substrate;

a crosslinked surface layer comprising α-alumina and tin oxide, overlying the photosensitive layer, wherein a first one-dimensional data array obtained from measuring a concavo-convex shape of the surface of the photoreceptor with a surface roughness/profile shape measurer is subjected to a first multiple image resolution analysis in which a wavelet conversion is made to the first one-dimensional data array to be separated into 6 frequency components HHH, HHL, HMH, HML, HLH and HLL having single-cycle lengths of a concavity and a convexity of from 0 to 3, 1 to 6, 2 to 13, 4 to 25, 10 to 0 and 24 to 99 μm, respectively, the one-dimensional data array of the frequency component HLL is further thinned so as to have 1/40 data arrays to obtain a second one-dimensional data array, the second one-dimensional data array is further subjected to a second multiple image resolution analysis in which the wavelet conversion is made to the second one-dimensional data array to be separated into additional 6 frequency components LHH, LHL, LMH, LML, LLH and LLL having single-cycle lengths of a concavity and a convexity of from 26 to 106, 53 to 183, 106 to 318, 214 to 551, 431 to 954 and 867 to 1, 654 μm, respectively, and wherein when relationships between respective arithmetic average roughness (WRa) (y-axis) of the 12 frequency components and the frequency components (x-axis) are graphed, at least WRa (LML) and WRa (LHH) have a folding point or a maximum point.

First, an applicator applying a solid lubricant to the surface of a photoreceptor in electrophotographic process will be explained.

The lubricant is applied thereto in the form of a powder in a small amount. As disclosed in Japanese published unexamined applications Nos. 2004-138643 and 2000-162881, a method of scraping a block of solid lubricant and applying the scraped lubricant thereto with an applicator such as brushes is simple and thought to stably apply the lubricant to the whole surface of a photoreceptor.

Figure 10:
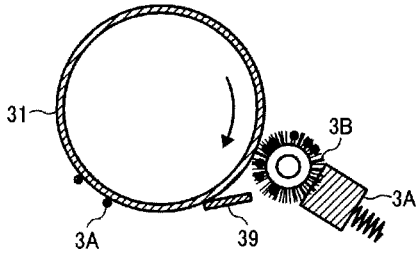
FIG. 10 is a schematic cross-sectional view illustrating another means of applying a solid lubricant to a photoreceptor.

FIG. 10 is a lubricant applicator. A solid lubricant (3A) is applied to a photoreceptor (31) through an application brush (3B). The application brush (3B) rotates contacting the solid lubricant (3A) to scrape off a part thereof. The scraped solid lubricant (3A) adheres to the application brush (3B) rotating to be applied to the photoreceptor (31). The solid lubricant applied thereto is spread thereon by a coating blade (39). When the solid lubricant is applied to a photoreceptor through a brush, etc., the surface of the photoreceptor is applied with a powdery lubricant, but its lubricity is not fully exerted as it is. It is important to spread the lubricant on the surface of the photoreceptor by the coating blade. The solid lubricant forms a film on the surface thereof to exert its lubricity.

The solid lubricant (3A) is typically a metal salt of higher fatty acid such as zinc stearate. The zinc stearate is typically a lamella crystal powder preferably used as a lubricant. The lamella crystal has a layer structure formed of self-organized amphipathic molecules, and is likely to interlamellarly crack when receiving a shear force and be slippery. This effectively lowers a friction coefficient, and even a small amount of the lubricant having a lamella crystal uniformly covering the surface of a photoreceptor with a shear force can effectively cover the surface of a photoreceptor. When a lubricant is applied by this method, there are various methods of controlling application status thereof such as means of increasing a contact pressure between the solid lubricant and the application brush and means of controlling a rotational speed of the application brush. The rotational speed of the application brush is also controlled according to image forming information.

Next, requirements of electrophotographic photoreceptors suitable for the solid lubricant application process were studied.

When such a solid lubricant applicator is used, an electrophotographic photoreceptor is required to have high solid lubricant receiving sensitivity. This is thought to be influenced by adherence of the solid lubricant to the photoreceptor and lubricant film formability of the coating blade.

Adherence between two things is studied in KONICA MINOLTA TECHNOLOGY REPORT Vol. 1, 19-22, 2004, written by Yukiko Mizuguchi and Takahito Miyamoto. The adherence is thought to be influenced by a nonelectrostatic attractive force, an electrostatic attractive force and a contact area therebetween. The electrostatic attractive force is thought to be caused by a contact potential difference. The nonelectrostatic attractive force is thought to be caused by surface energy such as wettability.

The solid lubricant essentially has low adherence, and even when various surface conditioners are included in the surface of a photoreceptor, the adherence between the lubricant and the photoreceptor could not largely be changed. The inventor studied roughening effect of the surface of a photoreceptor, though up from a contact area as another factor ρ.

Figure 11:
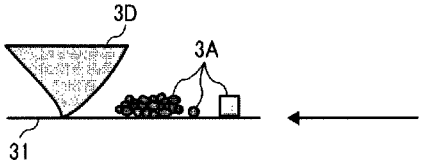
FIG. 11 is a schematic view illustrating a solid lubricant adheres to the photoreceptor.
Figure 12:
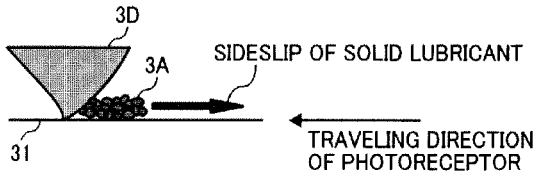
FIG. 12 is a schematic view illustrating a solid lubricant is poorly coated on a photoreceptor.
Figure 13:
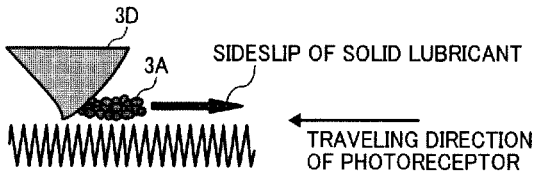
FIG. 13 is another schematic view illustrating a solid lubricant is poorly coated on a photoreceptor.

FIG. 11 is an example in which the influence of the surface profile is considered. A powder of the solid lubricant scraped by the application brush adheres to the surface of a photoreceptor as an aggregate or a solid form. When the photoreceptor has a smooth surface, it is thought the solid lubricant cannot pass the coating blade and releases from the surface of the photoreceptor after sideslipping thereon as FIG. 12 shows. When the surface of the photoreceptor has large concavities and convexities as FIG. 13 shows, the solid lubricant contacts the photoreceptor at points and the solid lubricant is thought to easily release from the surface thereof as well.

Figure 14:
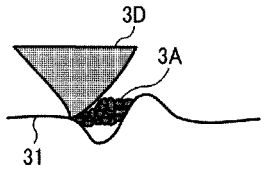
FIG. 14 is a further schematic view illustrating a solid lubricant is poorly coated on a photoreceptor.
Figure 15:
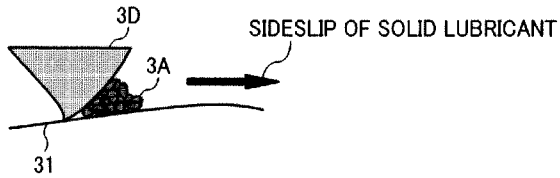
FIG. 15 is a schematic view illustrating concavities and convexities of low-frequency components on a photoreceptor vary a linear pressure of a coating blade.
Figure 16:
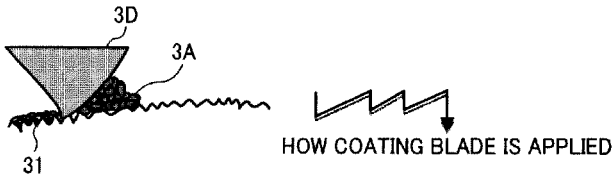
FIG. 16 is a schematic view illustrating a solid lubricant is well coated on a photoreceptor.

Unless concavities and convexities on the surface of a photoreceptor have a proper cycle, an aggregate of the solid lubricant as shown in FIG. 14 contacts the photoreceptor at points at the edge of the concavities and convexities and is thought to easily release from the surface thereof although preventing the solid lubricant from sideslipping. As shown in FIG. 15, moderate concavities and convexities are formed on the surface of a photoreceptor such that the coating blade properly increases and decreases a linear pressure so that the solid lubricant scrapes through the blade and presses the lubricant to be spread on the surface thereof. Further, proper high-frequency concavities and convexities preventing the solid lubricant from sideslipping as shown in FIG. 16 are overlapped to increase the adherence of the solid lubricant.

Even when concavities and convexities on the surface of a photoreceptor are evaluated by a central line average roughness (arithmetic average roughness) Ra or an undulation RSm measured by a conventional surface roughness or a profile shape measurer, they are just very roughly classified. The present inventor found that when one-dimensional array data of a profile curve of a photoreceptor subjected to a multiple image resolution analysis using a wavelet conversion satisfies the above-mentioned requirements, roughing the surface of the photoreceptor is controllable.

Hereinafter, the multiple image resolution analysis of the profile curve of a photoreceptor will be explained.

In the present invention, first a profile curve of the surface of the electrophotographic image forming apparatus component is measured, based on JIS B0601, and a one-dimensional data ta array of the profile curve is obtained. The one-dimensional data array of the profile curve may be a digital signal obtained from a surface roughness or profile shape measurer or a digital signal converted from an analog output therefrom.

In the present invention, the measurement length is preferably a length specified in JIS standard of from 8 to 25 mm.

A sampling interval is preferably not greater than 1 μm, and more preferably from 0.2 to 0.5 μm. For example, when a measurement length 12 mm is measured at sampling points of 30, 720, the sampling interval is 0.390625 μm.

Figure 42:
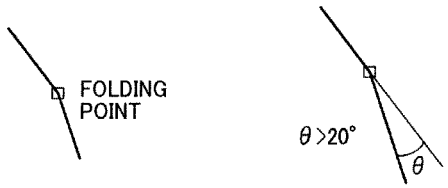
FIG. 42 is a schematic view for explaining a folding point in the present invention.

As mentioned above, the one-dimensional data array is subjected to a multiple image resolution analysis in which a wavelet conversion is made to it (MRA-1) to be separated into plural frequency components of from a high-frequency component (HHH) to a low-frequency component (HLL), e.g., 6 frequency components such as (HHH), (HHL), (HMH), (HML), (HLH) and (HLL). Further, the lowest frequency component (HLL) is thinned to form a one-dimensional data array, and which is further subjected to a multiple image resolution analysis in which a wavelet conversion is made to it (MRA-2) to be separated into plural frequency components of from a high-frequency component to a low-frequency component, e.g., 6 components such as (LHH), (LHL), (LMH), (LML), (LLH) and (LLL). The central line average roughness (WRa) of each frequency component is determined. To tell from a conventional Ra, WRa is used in the present invention. In the present invention, WRa (LML) and WRa (LHH) at least have a folding point or a maximum point. In the present invention, the folding point is a point where a curvature suddenly changes. i.e., a peak of a convex angle. As FIG. 42 shows, when the convex angle having no folding point is 0° at a scale size of diagrams in the present invention, the convex angle having an angle not less than 20° is recognized as a folding point, and the convex angle having an angle less than 20° is not recognized as a folding point.

A wavelet conversion is made to the arithmetic average roughness (Ra) of an electrophotographic photoreceptor defined in JIS-B0601:2001 to be separated into frequency components of one periodic length of concavities and convexities, and the arithmetic average roughness of each of which is as follows:

WRa (HHH): Ra in a band frequency where one periodic length of concavities and convexities is from 0 to 3 μm;

WRa (HHL): Ra in a band frequency where one periodic length of concavities and convexities is from 1 to 6 μm;

WRa (HMH): Ra in a band frequency where one periodic length of concavities and convexities is from 2 to 13 μm;

WRa (HML): Ra in a band frequency where one periodic length of concavities and convexities is from 4 to 25 μm;

WRa (HLH): Ra in a band frequency where one periodic length of concavities and convexities is from 10 to 50 μm;

WRa (HLL): Ra in a band frequency where one periodic length of concavities and convexities is from 24 to 99 μm;

WRa (LHH): Ra in a band frequency where one periodic length of concavities and convexities is from 26 to 106 μm;

WRa (LHL): Ra in a band frequency where one periodic length of concavities and convexities is from 53 to 183 μm;

WRa (LMH): Ra in a band frequency where one periodic length of concavities and convexities is from 106 to 318 μm;

WRa (LML): Ra in a band frequency where one periodic length of concavities and convexities is from 214 to 551 μm;

WRa (LLH): Ra in a band frequency where one periodic length of concavities and convexities is from 431 to 954 μm; and WRa (LLL): Ra in a band frequency where one periodic length of concavities and convexities is from 867 to 1,654 μm.

Each of the central line average roughness (WRa) is a central line average roughness of a one-dimensional data array obtained by subjecting one-dimensional data array obtained by measuring a concave and convex shape of the surface of an electrophotographic photoreceptor with a surface roughness or a profile shape measurer to the multiple image resolution analyses MRA-1 and MRA-2 in which the a wavelet conversion is made to the one-dimensional data array to be separated into frequency components of from high-frequency components to low-frequency components. In the present invention, the wavelet conversion uses a numerical analyzing software called MATLAB. The definition of a bandwidth is a limit of the software and does not have a particular meaning. Coefficients change according to the bandwidths. The frequency bands between HML and HLH, LHL and LMH, LMH and LML, LML and LLH, and LLH and LLL are overlapped, respectively. Namely, an original signal is separated into L (Low-pass Components) and H (High-pass components) through a first wavelet conversion (Level 1). A wavelet conversion is further made to L to be separated into LL and HL. When a frequency component f included in an original signal is the same as a separated frequency F, f is just a border of separation and separated into L and H. This is inevitable in the multiple image resolution analysis. It is important to set the frequency included in the original signal such that a frequency band to be observed is not separated when a wavelet conversion is made thereto. After some wavelet conversions are exerted, a signal separated into plural band frequencies is effectively resumed by a reverse wavelet conversion.

In the present invention, two wavelet conversions are made. The first wavelet conversion is referred to as MRA-1. The second wavelet conversion is referred to as MRA-2. To separate the first from the second conversion, H (first) or L (second) is added to an abbreviation of each frequency band as a prefix.

Various wavelet functions can be used as a mother wavelet function used for the first and the second wavelet conversions, such as Daubecies function, Haar function, Meyer function, Symlet function and Coiflet function. Haar function is used as a mother wavelet function in the present invention. The multiple image resolution analysis is made to a one-dimensional data array to be separated into 6 components of from high-frequency components to low-frequency components. Data thinning is 1/40 in the present invention.

When the multiple image resolution analysis in which a wavelet conversion is made to a one-dimensional data array to be separated into plural frequency components is made, the number of the components is preferably from 4 to 8, and more preferably 6.

In the present invention, the first wavelet conversion is made to a one-dimensional data array to be separated into plural frequency components. The lowest frequency component is sampled while thinned to form another one-dimensional data array reflecting the lowest frequency component. The second wavelet conversion is made to the one-dimensional data array to execute a multiple image resolution analysis separating the one-dimensional data array into plural frequency components of from high-frequency components to low-frequency components.

The lowest frequency component (HLL) obtained by the first wavelet conversion (MRA-1) is preferably thinned so as to decrease data arrays from 1/10 to 1/100, but 1/40 in the present invention.

The data thinning effectively increases data frequency (expands an x-axial logarithmic scale width). For example, 30,000 one-dimensional arrays obtained by the first wavelet conversion become 3,000 when thinned by 1/10.

When thinned by less than 1/10, e.g., 1/5, the data frequency is less increased. Even when the second wavelet conversion is made to the one-dimensional data array to execute a multiple image resolution analysis, the data are not separated well.

When thinned by greater than 1/100, e.g., 1/200, the data frequency is too high, and even when the second wavelet conversion is made to the one-dimensional data array to execute a multiple image resolution analysis, the data are concentrated in high-frequency components and are not separated well.

When thinned by 1/100, an average of 100 data is a representative one point.

Figure 17:
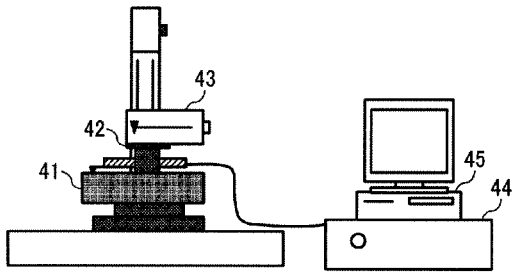
FIG. 17 is a configuration diagram of a surface roughness/profile shape measurement system.

FIG. 17 is a configuration diagram of a surface roughness/profile shape measurement system for an electrophotographic photoreceptor for use in the present invention. 41 is an electrophotographic photoreceptor, 42 is a jig with a probe measuring the surface roughness, 43 is a mechanism transferring the jig 42 along an object to be measured, 44 is a surface roughness/profile shape measurer, and 45 is a personal computer analyzing a signal. The multiple image resolution analysis is made by the personal computer 45. When the electrophotographic photoreceptor has the shape of a cylinder, the surface roughness thereof can be measured in a circumferential or a longitudinal direction.

FIG. 17 is one of embodiments, and the configuration may be other configurations. For example, the multiple image resolution analysis may be made by an exclusive numerical calculation processor, not by a personal computer. Alternatively, the multiple image resolution analysis may be made by the surface roughness/profile shape measurement system. The results may be displayed in various methods such as CRT, LCD and printing. They may be transmitted to other apparatuses as electrical signals, and stored in a USB memory or a MO disc.

In the present invention, Surfcom 1400D from TOKYO SEIMITSU CO., LTD. is used as the surface roughness/profile shape measurer, a personal computer from IBM Corp. is used as the personal computer, and they are connected through an RS-232-C cable. A process and a multiple image resolution analyzing calculation of the surface roughness data sent to the personal computer from Surfcom 1400D are made by a software written in C language.

Next, the procedure of the multiple image resolution analysis of the surface profile of a photoreceptor will specifically be explained.

First, the surface profile of an electrophotographic photoreceptor is measured by Surfcom 1400D from TOKYO SEIMITSU CO., LTD.

The measurement length at a time is 12 mm and the total sampling points were 30,720.

4 points are measured at a time. The measured results are taken in the personal computer, and a first wavelet conversion is made thereto through a program made by the inventor. Then, the resultant lowest frequency component is thinned to 1/40, and a second wavelet conversion is made to the thinned frequency component.

The central line average roughness Ra, the maximum height Rmax and the ten-point average roughness Rz of the first and the second multiple image resolution analyses are determined. An example of the results is shown in FIG. 18.

Figure 18:
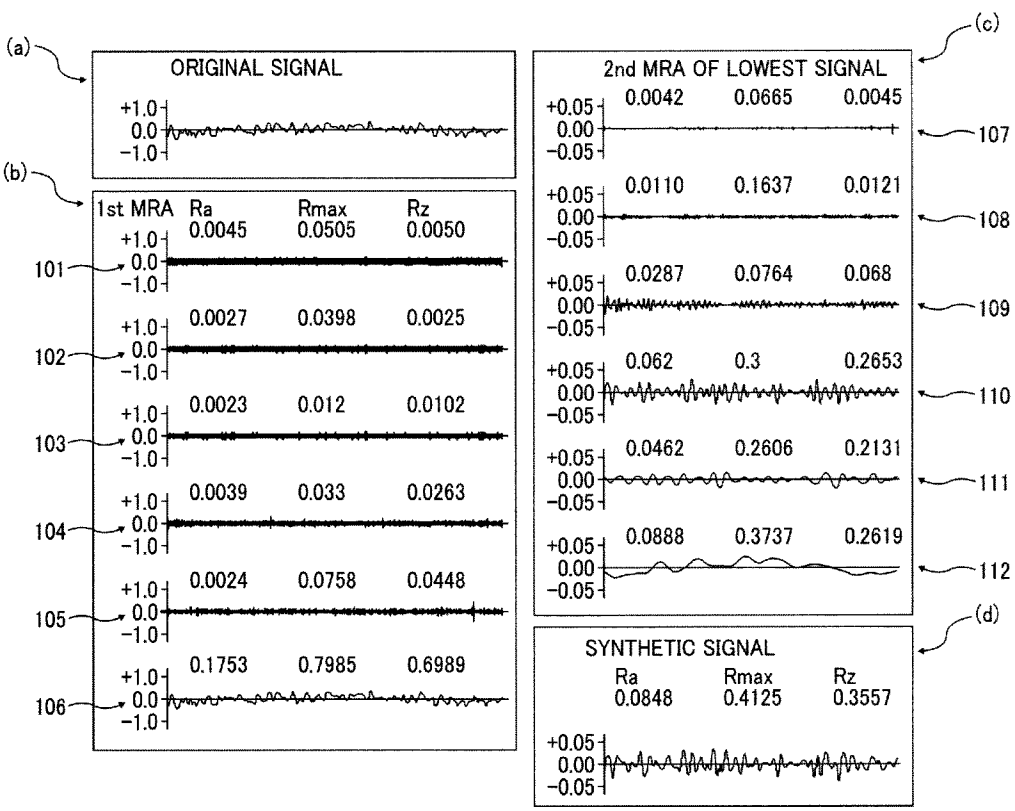
FIG. 18 is a diagram showing a result of a multiple image resolution analysis with a wavelet conversion.

In FIG. 18, a diagram (a) is original data measured by Surfcom 1400D, and may be called a roughness curve or a profile curve.

FIG. 18 includes 14 diagrams, in which a y-axis is a displacement of the surface profile in units of μm. An x-axis is a length of 12 mm.

The central line average roughness Ra, the maximum height Rmax and the ten-point average roughness Rz have conventionally been determined only from the data.

6 diagrams in (b) are results of the first multiple image resolution analyses (MRA-1), and a diagram of the maximum frequency component (HHH) is at the top and the lowest frequency component (HLL) is at the bottom.

A diagram 101 at the top in FIG. 18(*b*) is the maximum frequency component that is the result of the first multiple image resolution analysis, and called HHH in the present invention.

A diagram 102 is a frequency component which is one step lower than the maximum frequency component that is the result of the first multiple image resolution analysis, and called HHL in the present invention.

A diagram 103 is a frequency component which is two steps lower than the maximum frequency component that is the result of the first multiple image resolution analysis, and called HMH in the present invention.

A diagram 104 is a frequency component which is three steps lower than the maximum frequency component that is the result of the first multiple image resolution analysis, and called HML in the present invention.

A diagram 105 is a frequency component which is four steps lower than the maximum frequency component that is the result of the first multiple image resolution analysis, and called HLH in the present invention.

A diagram 106 is a frequency component which is the lowest frequency component that is the result of the first multiple image resolution analysis, and called HLL in the present invention.

In the present invention, the diagrams in FIG. 18(*a*) are separated into diagrams in FIG. 18(*b*) according to their frequencies. The frequency separations are shown in FIG. 19.

Figure 19:
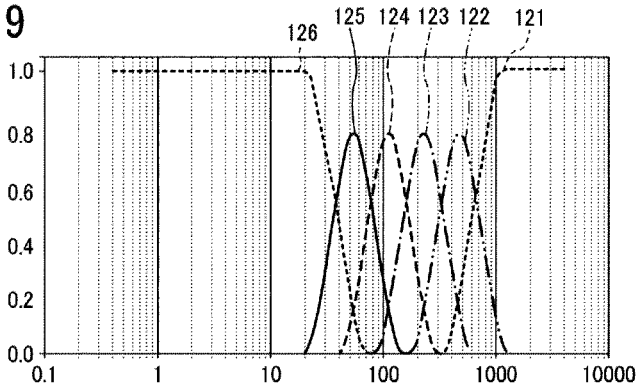
FIG. 19 is a diagram showing separation of a frequency band in the first multiple image resolution analysis.
Figure 20:
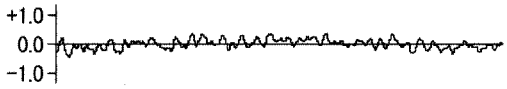
FIG. 20 is a diagram showing the lowest frequency data in the first multiple image resolution analysis.
Figure 21:
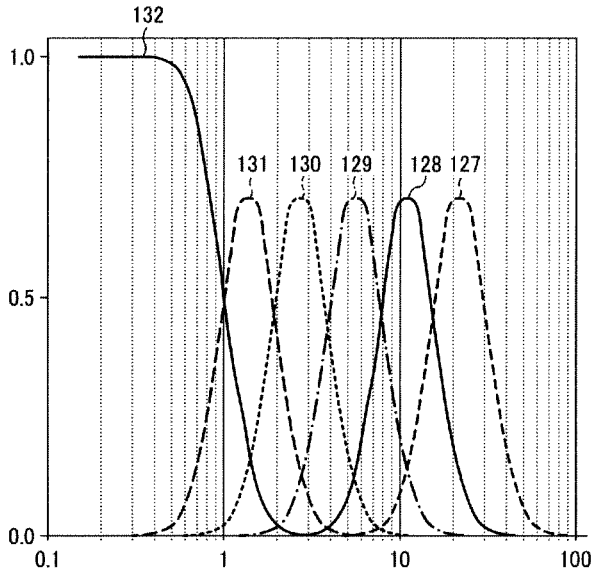
FIG. 21 is a diagram showing separation of a frequency band in the second multiple image resolution analysis.

In FIG. 19, an x-axis is the number of concavities and convexities at a length of 1 mm when the concavities and convexities have the shape of a sine wave. A y-axis is a ratio when the frequencies are separated into respective band frequencies.

In FIG. 19, 121 is a band frequency of the maximum frequency component (HHH) in the first multiple image resolution analysis (MRA-1), 122 is a band frequency which is one step lower than the maximum frequency component (HHL) in the first multiple image resolution analysis, 123 is a band frequency which is two steps lower than the maximum frequency component (HMH) in the first multiple image resolution analysis, 124 is a band frequency which is three steps lower than the maximum frequency component (HML) in the first multiple image resolution analysis, 125 is a band frequency which is four steps lower than the maximum frequency component (HLH) in the first multiple image resolution analysis, and 126 is a band frequency which is the lowest frequency component (HLL) in the first multiple image resolution analysis.

In FIG. 19, when the number of concavities and convexities at 1 mm is 20 or less, all of them appear in the diagram 126. For example, when the number of concavities and convexities at 1 mm is 100, they appear in the diagram 124 most. In FIG. 18(*b*), they appear in HML. When the number of concavities and convexities at 1 mm is 220, they appear in the diagram 123 most. In FIG. 18(*b*), they appear in HMH. When the number of concavities and convexities at 1 mm is 310, they appear in the diagrams 122 and 123, and in both HHL and HMH in FIG. 18(*b*). Therefore, a frequency of the surface roughness selects one of the 6 diagrams in FIG. 18(*b*). In other words, slight roughness appear in the upper diagrams in FIG. 18(*b*), and large waves appear in the lower diagrams therein.

In the present invention, the surface roughness is analyzed bi its frequency. This is shown in diagram 18(*c*), from which the surface roughness is determined at each frequency band. The central line average roughness Ra (WRa), the maximum height Rmax (WRmax), and the ten-point average roughness Rz (WRz) can be determined.

Thus, a multiple image resolution analysis is made, in which a wavelet conversion is made to a one-dimensional data array obtained from measuring a concave and convex shape on the surface of an electrophotographic photoreceptor with a surface roughness/profile shape measurer using Haar function as a mother wavelet function to be separated into plural frequency components of from high to low frequency components. Further, the resultant lowest frequency component is thinned to form another one-dimensional data array. Another multiple image resolution analysis is made, in which another wavelet conversion is made to the one-dimensional data to be separated into plural frequency components of from high to low frequency components. The central line average roughness Ra (WRa), the maximum height Rmax (WRmax), and the ten-point average roughness Rz (WRz) of each frequency component are shown in Table 1.

TABLE 1

| Multiple image resolution analysis | Signal | Surface Roughness Ra | Rmax | Rz |
|---|---|---|---|---|
| First | HHH | 0.0045 | 0.0505 | 0.0050 |
| | HHL | 0.0027 | 0.0398 | 0.0025 |
| | HMH | 0.0023 | 0.0120 | 0.0102 |
| | HML | 0.0039 | 0.0330 | 0.0263 |
| | HLH | 0.0024 | 0.0758 | 0.0448 |
| | HLL | 0.1753 | 0.7985 | 0.6989 |
| Second | LHH | 0.0042 | 0.0665 | 0.0045 |
| | LHL | 0.0110 | 0.1637 | 0.0121 |
| | LMH | 0.0287 | 0.0764 | 0.0680 |
| | LML | 0.0620 | 0.3000 | 0.2653 |
| | LLH | 0.0462 | 0.2606 | 0.2131 |
| | LLL | 0.0888 | 0.3737 | 0.2619 |

Figure 22:
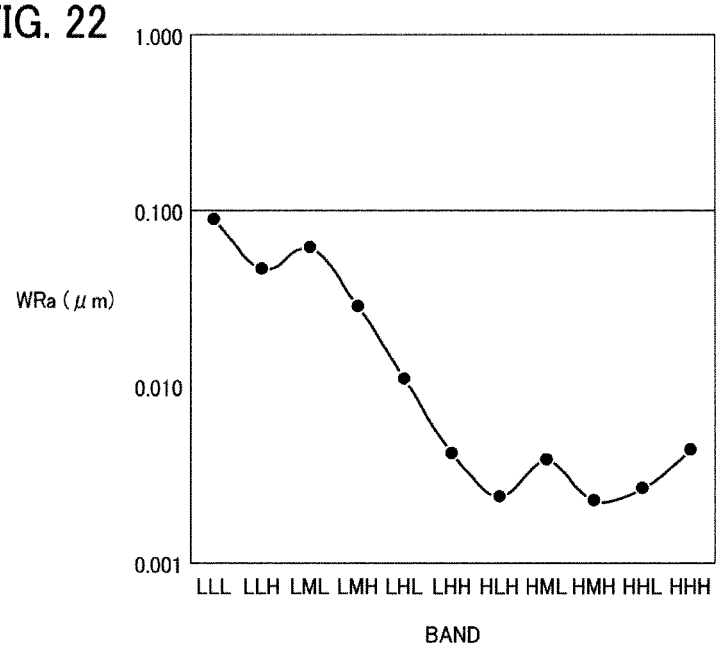
FIG. 22 is a surface roughness spectrum of a profile curve in FIG. 18.

Relating to the profile curve in FIG. 18, the surface roughness of each signal is plotted and connected with a line to form a profile in FIG. 22. The LHH component is arithmetically an unusual value, and the surface roughness of this band frequency is omitted. This profile is called a surface roughness spectrum or a roughness spectrum.

The surface of a photoreceptor is roughened by various methods, e.g., adding a chemical capable of controlling a shape such as fillers in a surface layer coating liquid, modifying preparation conditions, applying machining process, etc. However, surface profiles formed by these methods have been unknown.

Relations between solid lubricant coatability and WRa on electrophotographic photoreceptors having various profile shapes support the present invention having low and high frequency components on the surface of a photoreceptor have concavities and convexities.

A crosslinked surface layer is advantageously formed on a photoreceptor to increase abrasion resistance thereof. Even when a part of chemical bond forming the resin layer is broken, the abrasion is prevented by a remaining chemical bond of the other part. Further, a filler having high hardness included in the layer further improves the abrasion resistance. This is effective for resource saving. Low-cost α-alumina having a hexagonal close-packed structure and imparting high surface hardness, obtained by gas phase polymerization is preferably used as the filler. The filler is almost spherical and does not make the surface of a photoreceptor spiny, and decreases damages against members sliding with the photoreceptor.

Such a combination of a crosslinking resin and a filler needs lowering a potential of an irradiated part of a photoreceptor appropriate to its mechanical strength and increasing cleanability of a toner appropriate to concavities and convexities of the surface profile. Tin oxide is mixed with α-alumina to decrease the potential of an irradiated part. A combination of tin oxide and α-alumina slightly makes the harness lower than when α-alumina is solely used. The surface roughness of the photoreceptor of the present invention slightly varies at $\pm 2N/mm^2$ (Martens hardness). Particularly, when a solid lubricant is applied to the surface of a photoreceptor, the variation is not a problem. Tin oxide has a Mohs hardness of from 6 to 7.

The high hardness of tin oxide is thought one of important requirements of the present invention for both of improvement of the abrasion resistance of a photoreceptor and reduction of a potential of the irradiated part. The cleanability is advantageously improved, together with concavities and convexities generated by a filler included, when the LML band (one cyclic length of concavities and convexities is from 214 to 551 μm) when the surface profile of a photoreceptor is expressed by the roughness spectrum of the present invention has a folding point. This is because concavities and convexities on the surface of a photoreceptor are thought to properly oscillate a member scraping the photoreceptor to lessen a stress thereof. Therefore, an apparent cleanability is thought to increase. The photoreceptor of the present invention satisfies the irradiated part potential, the mechanical strength and the cleanability.

An object of the present invention is to provide a photoreceptor having high durability and improved cleanability. The photoreceptor of the present invention has neither poor hardness nor an extreme accumulation of residual potential.

Figure 23:
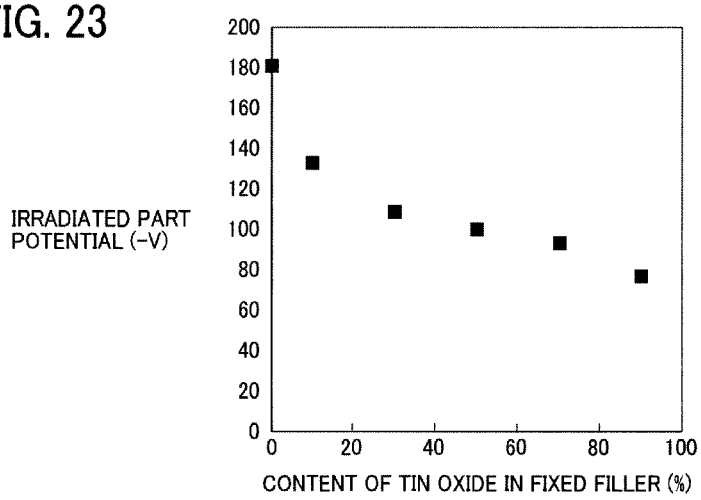
FIG. 23 is a diagram showing a relationship between the content of tin oxide in a mixed filler and reduction of irradiated part potential.
Figure 24:
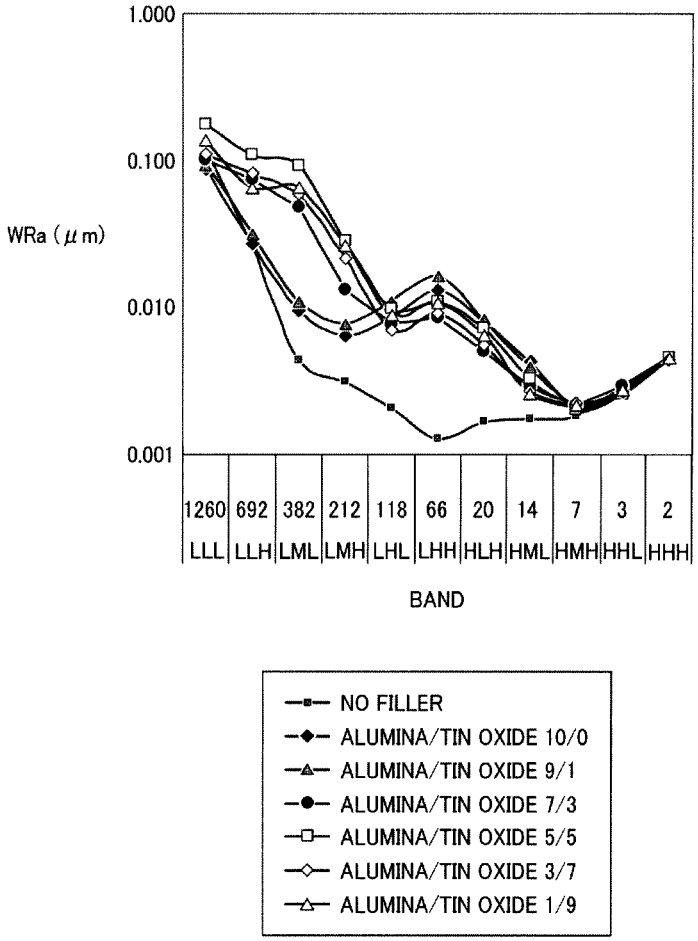
FIG. 24 is a diagram showing a roughness spectrum of a mixed filler including α-alumina and tin oxide.

As mentioned above, a combination with tin oxide especially works for reduction of irradiated part potential and improvement of cleanability. A mixing ratio of tion oxide is preferably from 20 to 70% by weight to reduce irradiated part potential. When too low, the potential is not sufficiently reduced. When too much, less effect because the reduction is saturated. This is shown in FIG. 23. A mixing ratio of tin oxide is preferably not less than 30% by weight to form a surface profile good for cleanability. Namely, a mixing ratio of tin oxide is not less than 30% by weight, and WRa (LML) and WRa (LHH) has a folding point or a maximum point. This is shown in FIG. 24.

The photoreceptor of the present invention has good irradiated part potential.

Figure 25:
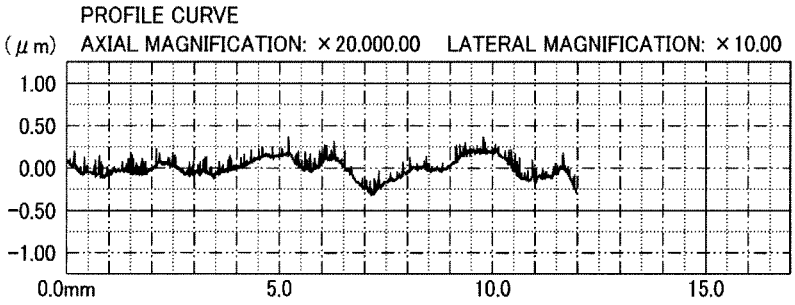
FIG. 25 is a diagram showing a profile curve (the content of tin oxide in a mixed filler is 30%)
Figure 26:
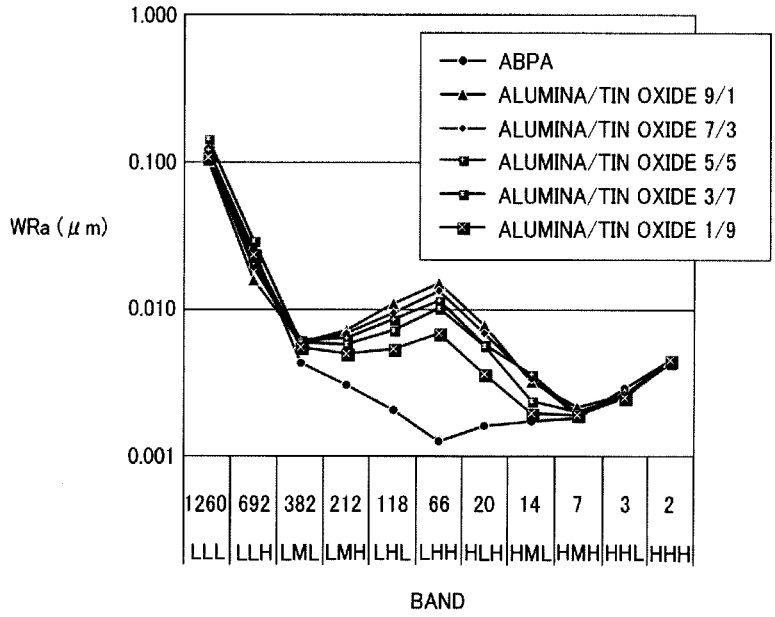
FIG. 26 is a diagram showing a roughness spectrum.
Figure 27:
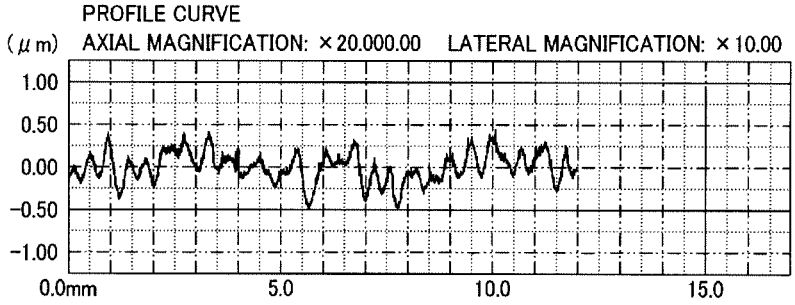
FIG. 27 is another diagram showing a profile curve (the content of tin oxide in a mixed filler is 30%)
Figure 28:
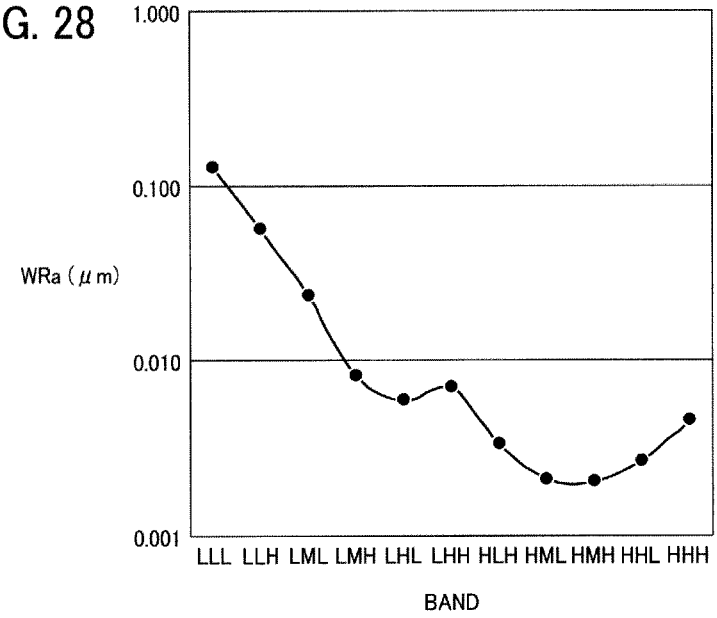
FIG. 28 is a relationship diagram of WRa broken down to frequency components.
Figure 29:
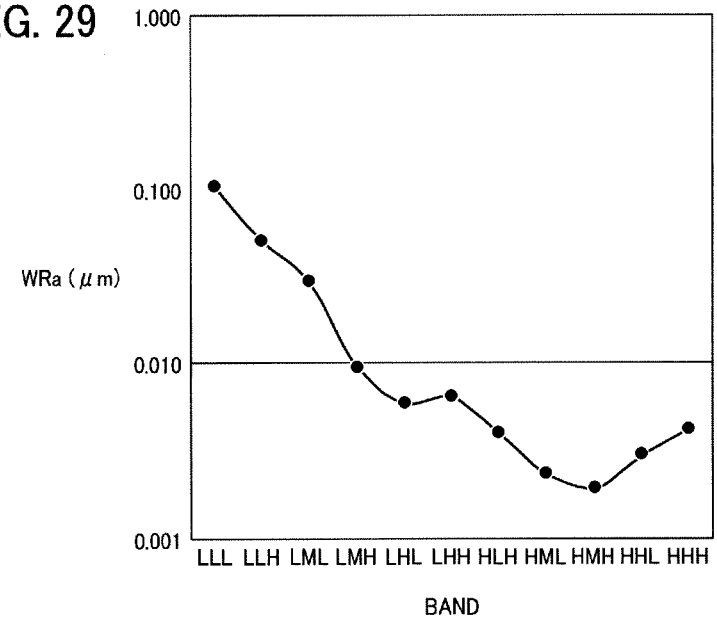
FIG. 29 is a relationship diagram of WRa broken down to frequency components.
Figure 30:
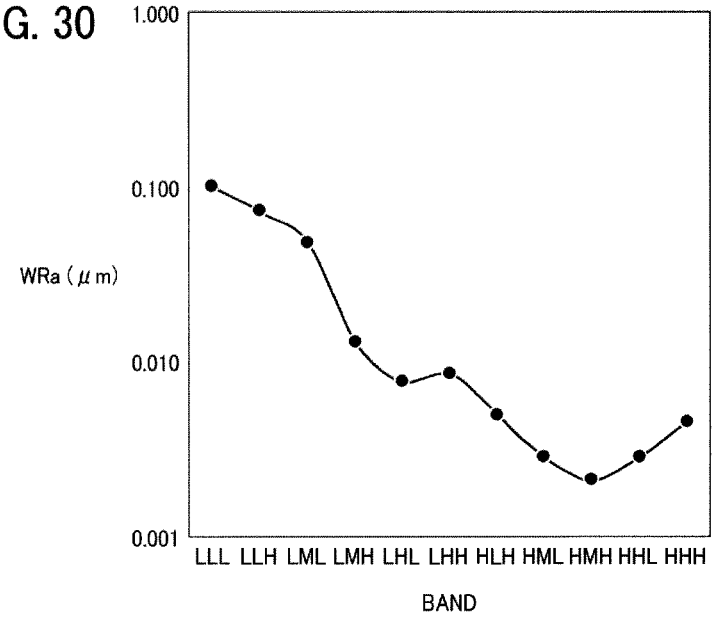
FIG. 30 is a relationship diagram of WRa broken down to frequency components.
Figure 31:
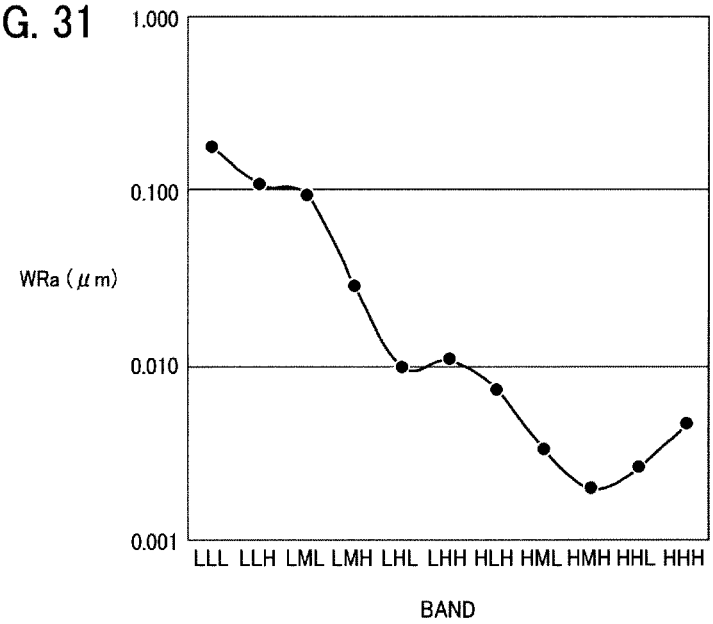
FIG. 31 is a relationship diagram of WRa broken down to frequency components.
Figure 32:
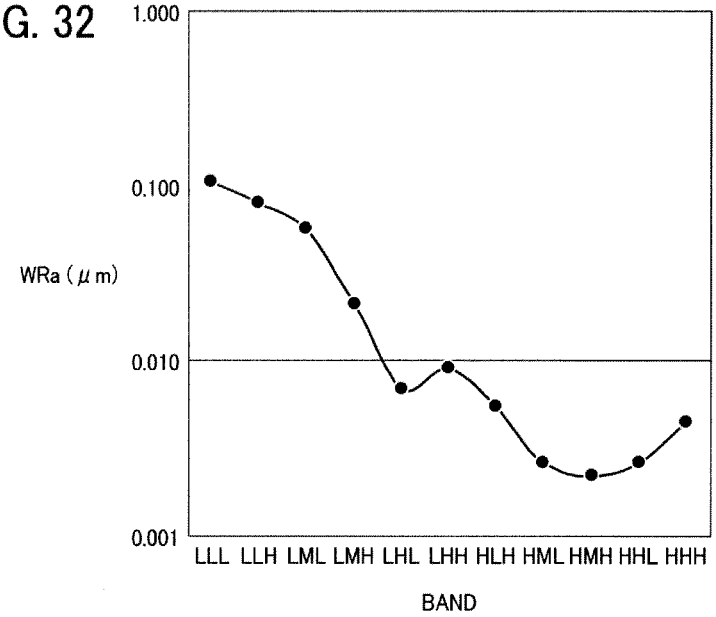
FIG. 32 is a relationship diagram of WRa broken down to frequency components.
Figure 33:
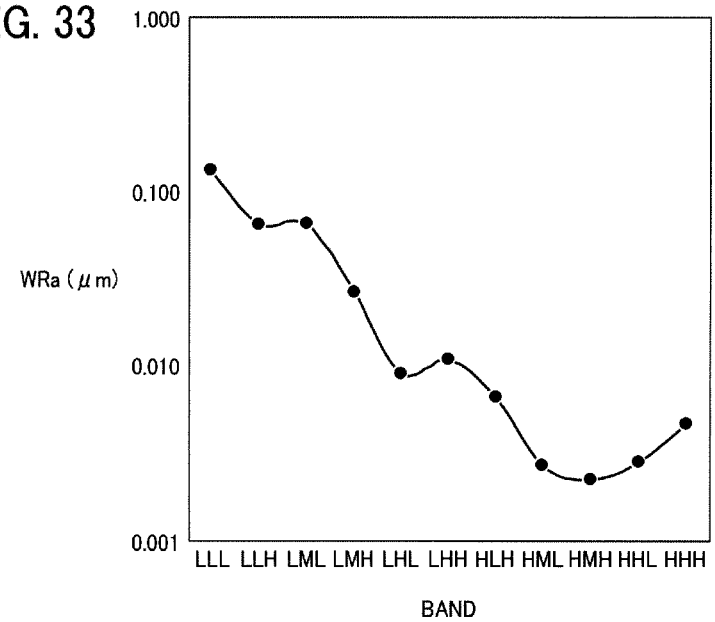
FIG. 33 is a relationship diagram of WRa broken down to frequency components.
Figure 34:
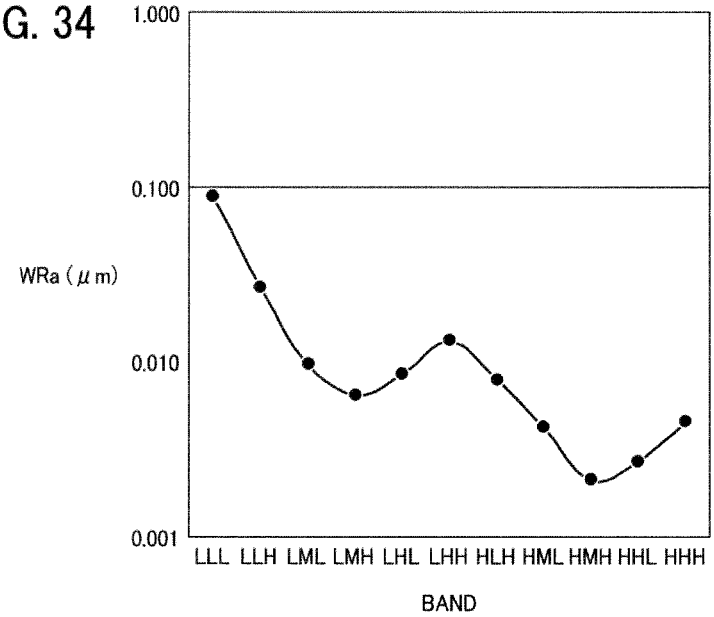
FIG. 34 is a relationship diagram of WRa broken down to frequency components.
Figure 35:
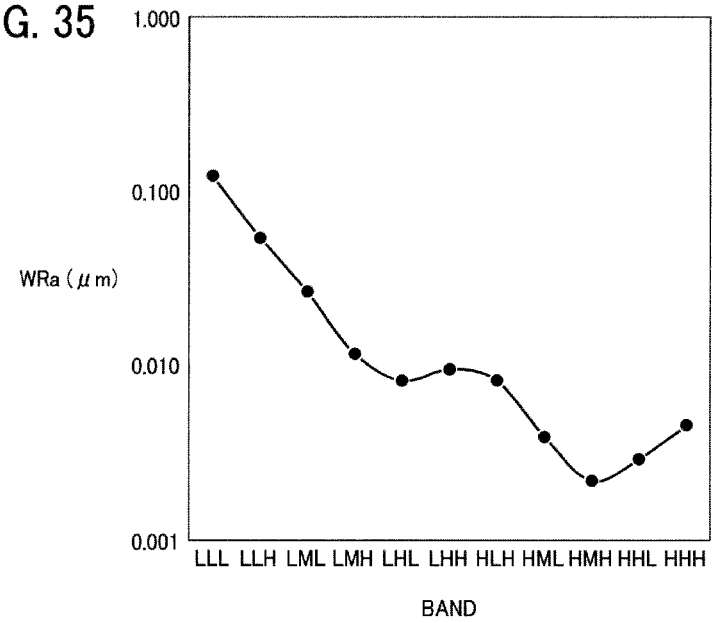
FIG. 35 is a relationship diagram of WRa broken down to frequency components.
Figure 36:
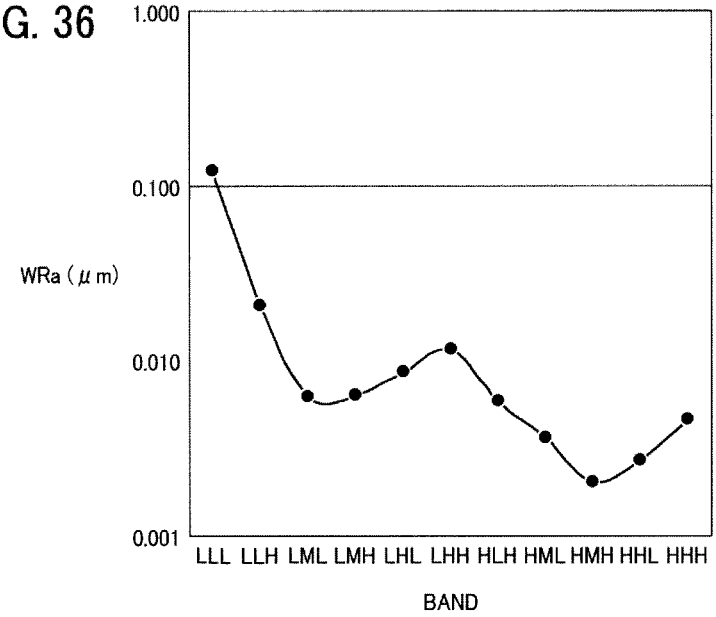
FIG. 36 is a relationship diagram of WRa broken down to frequency components.
Figure 37:
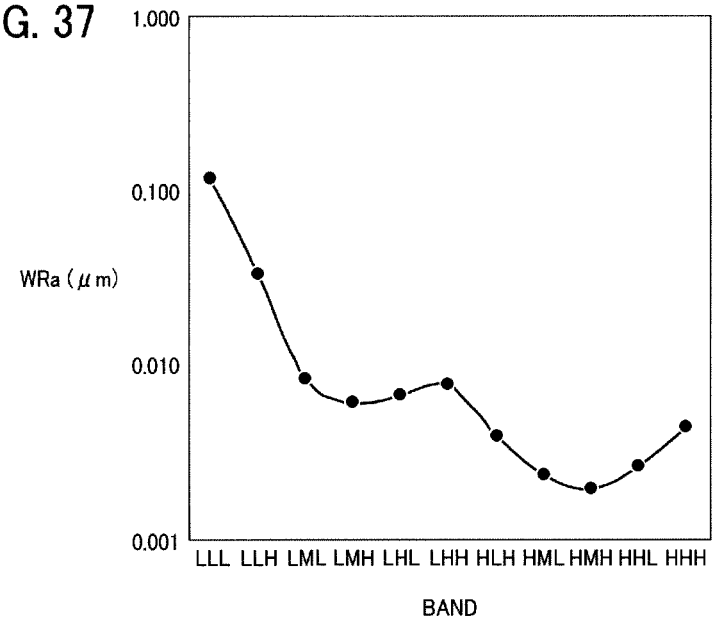
FIG. 37 is a relationship diagram of WRa broken down to frequency components.
Figure 38:
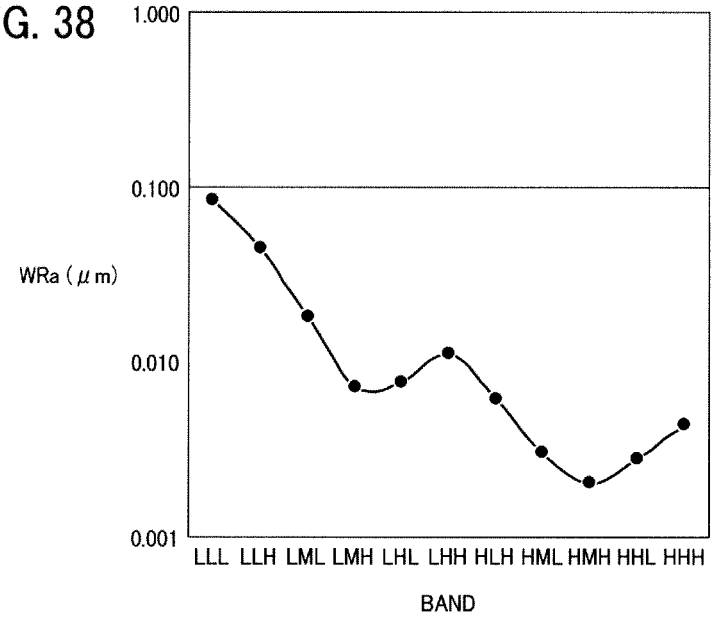
FIG. 38 is a relationship diagram of WRa broken down to frequency components.
Figure 39:
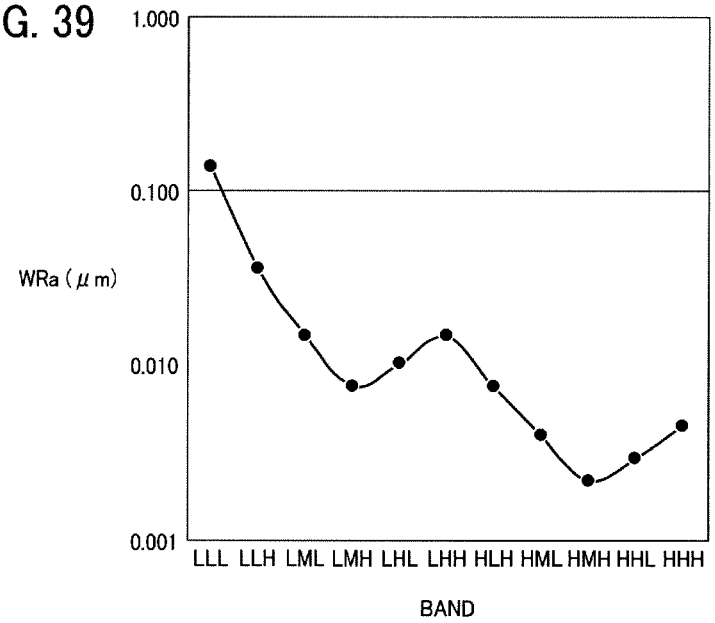
FIG. 39 is a relationship diagram of WRa broken down to frequency components.
Figure 40:
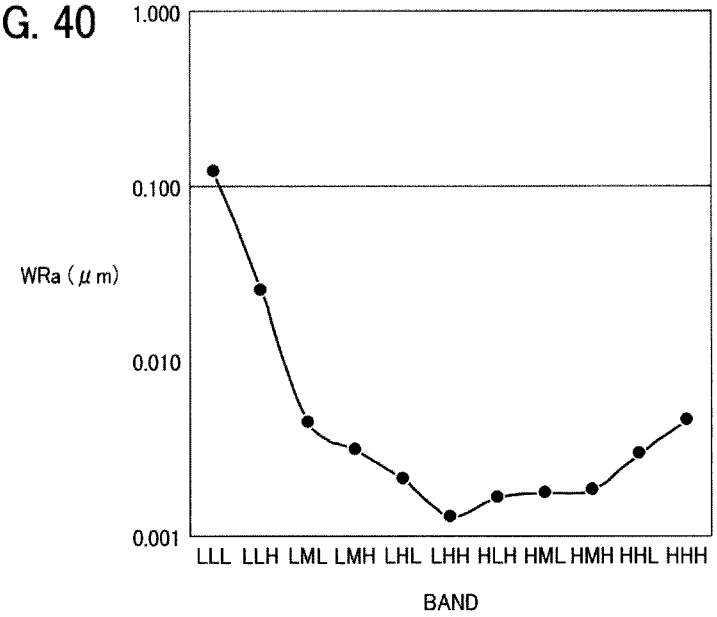
FIG. 40 is a relationship diagram of WRa broken down to frequency components.
Figure 41:
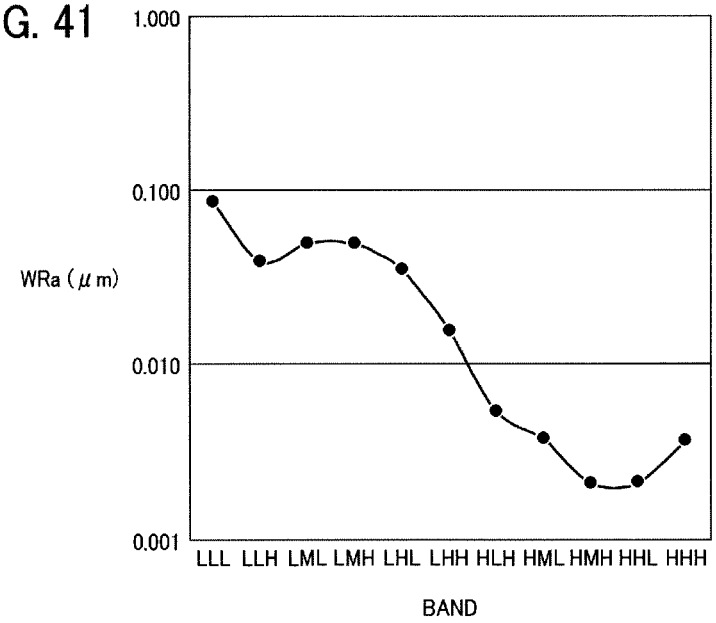
FIG. 41 is a relationship diagram of WRa broken down to frequency components.

When α-alumina and tin oxide are included in a crosslinked surface layer of a photoreceptor, the surface profile thereof has plural fibrous convexities. The profile curve of the photoreceptor is shown in FIG. 25. Almost no shoulder or maximum point is observed in WRa of low-frequency components of roughness spectrum. This is shown in FIG. 26. A filler dispersant varies the surface profile. The aggregational or dispersed state of a filler is thought to create the surface profile of a photoreceptor. The change of the dispersant of a filler changes the profile curve in FIG. 25 into one in FIG. 27. Namely, the dispersant of a filler is thought to partially control the surface profile of a photoreceptor. When the dispersant is an amine dispersant, specifically having an amine value not less than 4 mg KOH/g, the fibrous convexities disappear and the low-frequency components have shoulders. Concavities and convexities of the low-frequency components are thought to have high cleanability because of properly oscillating a member scraping the photoreceptor to lessen a stress thereof.

The photoreceptor of the present invention has good cleanability.

Typically, a toner placed on the outermost surface of a photoreceptor produces distorted images when developed under an environment of high humidity. A binder resin including an acrylate structural unit having an acryloyloxy group and a charge transportable structural unit in a crosslinked surface layer solves this problem. The photoreceptor which does not need a drum heater can be applied to wide ranges of image forming apparatuses, i.e., to even low-end apparatuses.

The photoreceptor of the present invention has high designability.

The process cartridge for use in the image forming apparatus of the present invention, in which a solid lubricant is scraped and applied to the surface of a photoreceptor with a brush improves coatability thereof and maintenability of the apparatus.

The image forming apparatus of the present invention, in which a solid lubricant is scraped and applied to the surface of a photoreceptor has highly stable maintenability.

Hereinafter, the electrophotographic photoreceptor of the present invention will be explained in detail, referring to the drawings.

Figure 7:
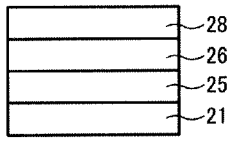
FIG. 7 is a cross-sectional view illustrating a layer constitution of the electrophotographic photoreceptor of the present invention.

FIG. 7 is a cross-sectional view of an embodiment of layers of the electrophotographic photoreceptor of the present invention, wherein a charge generation layer (CGL) 25, a charge transport layer (CTL) 26 and a crosslinked surface layer 28 are formed on an electroconductive substrate 21.

Figure 8:
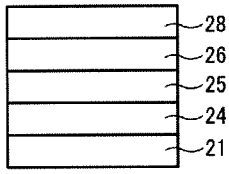
FIG. 8 is a cross-sectional view illustrating another layer constitution of the electrophotographic photoreceptor of the present invention.

FIG. 8 is a cross-sectional view of another embodiment of layers of the electrophotographic photoreceptor of the present invention, wherein an undercoat layer 24 is formed between an electroconductive substrate 21 and a CGL 25, and a CTL 26 and a crosslinked surface layer 28 are formed on the CGL 25.

Suitable materials as the electroconductive substrate 21 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver and platinum, or a metal oxide such as tin oxides and indium oxides, is deposited or sputtered. In addition, a plate of a metal such as aluminum, aluminum alloys, nickel and stainless steel and a metal cylinder, which is prepared by tubing a metal such as the metals mentioned above by a method such as drawing ironing, impact ironing, extruded ironing and extruded drawing, and then treating the surface of the tube by cutting, super finishing, polishing and the like treatments, can also be used as the substrate.

In the photoreceptor of the present invention, an undercoat layer 24 can be formed between the substrate and a photosensitive layer to improve adhesion between the substrate and the photosensitive layer; to prevent formation of moiré; to improve the coating property of the overlying layer; to reduce the residual potential; and to prevent injection of charges from the substrate into the photosensitive layer. The undercoat layer typically includes a resin as a main component. Since a photosensitive layer is typically formed on the undercoat layer by coating a liquid including an organic solvent, the resin in the undercoat layer is preferably a thermosetting resin difficult to dissolve in organic solvents. Particularly, polyurethane resins, melamine resins and alkyd-melamine resins are preferably used. The resins are dissolved in a solvent such as tetrahydrofuran, cyclohexanone, dioxane, dichloroethane, butanone to prepare a coating liquid.

The undercoat layer may include a particulate metal or a metal oxide to adjust the conductivity and prevent formation of moiré. Particularly, titanium oxide is preferably used.

The particulate metal or metal oxide is dispersed in a solvent such as tetrahydrofuran, cyclohexanone, dioxane, dichloroethane, butanone to prepare a dispersion, and the dispersion is mixed with a resin to prepare a coating liquid.

The undercoat layer can be formed by coating the coating liquid on a substrate by a method such as a dip coating method, a spray coating method and a bead coating method, and optionally by heat curing.

The undercoat layer preferably has a thickness of from 2 to 5 μm, and preferably less than 3 μm when the residual potential of a photoreceptor becomes large.

A multilayered photosensitive layer including a CGL and CTL is preferably used in the present invention.

The CGL 25 in the multilayered photosensitive layer will be explained. The charge generation layer is a part of the multilayered photosensitive layer and generates a charge when irradiated. Among compounds included in this layer, a charge generation material is a main component thereof. A binder resin is optionally used in the charge generation layer. Inorganic materials and organic materials can be used as the charge generation material.

Specific examples of the inorganic materials include crystalline selenium, amorphous selenium, selenium-tellurium alloys, selenium-tellurium-halogen alloys, selenium-arsenic alloys and amorphous silicone. The amorphous silicone prepared by terminating a dangling bond with a hydrogen atom or a halogen atom, or doping a boron atom or a phosphorus atom.

Specific examples of the organic charge generation materials include known materials, for example, phthalocyanine pigments such as metal phthalocyanine and metal-free phthalocyanine, azulenium pigments, squaric acid methine pigments, symmetric or asymmetric azo pigments having a carbazole skeleton, symmetric or asymmetric azo pigments having a triphenylamine skeleton, symmetric or asymmetric azo pigments having a fluorenone skeleton, perylene pigments, etc. Among these materials, the metal phthalocyanine, symmetric or asymmetric azo pigments having a fluorenone skeleton, symmetric or asymmetric azo pigments having a triphenylamine skeleton and perylene pigments are preferably used because they all have high charge generation quantum efficiency. These charge generation materials can be used alone or in combination.

Specific examples of the binder resin optionally used in the CGL include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination.

Suitable methods for forming the CGL are broadly classified into thin film forming methods in a vacuum and casting methods.

Specific examples of the former thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods for forming the charge generation layer typically include the following steps:

(1) preparing a coating liquid by mixing one or more inorganic or organic charge generation materials mentioned above with a solvent such as tetrahydrofuran, cyclohexanone, dioxane, dichloroethane, butanone and the like, optionally together with a binder resin and an additive, and then dispersing the materials with a ball mill, an attritor, a sand mill or the like, to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The CGL preferably has a thickness of from about 0.01 to 5 μm.

The CGL preferably has a thinner thickness when the photoreceptor needs reduction of residual potential and higher sensitivity. At the same time, the charge retainability and space charge formation thereof often deteriorate. In order to balance the properties, the CGL more preferably has a thickness of from about 0.05 to 2 μm.

The CGL can optionally include one or more low-molecular-weight compounds such as antioxidants, plasticizers, lubricants and ultraviolet absorbents, and a leveling agent. The CGL preferably includes these in an amount of from 0.1 to 20 phr, more preferably from 0.1 to 10 phr, and the leveling agents in an amount of from 0.001 to 0.1 phr.

The CTL is a part of the multilayered photosensitive layer, which receives a charge generated in the CGL, and transports the charge to a surface of a photoreceptor to neutralize a charge thereof. A main component of the charge transport layer not including a fluorine-containing resin is a charge transport material and a binder resin binding this.

The charge transport materials include low-molecular-weight electron transport materials, positive hole transport materials and polymeric charge transport materials.

Specific examples of the electron transport materials include electron accepting materials such as an asymmetric diphenoquinone derivative, a fluorene derivative and a naphthalimide derivative. These electron transport materials can be used alone or in combination.

Specific examples of the positive hole transport materials include electron donating materials such as an oxazole derivative, an oxadiazole derivative, an imidazole derivative, a triphenylamine derivative, 9-(p-diethylaminostyrylanthracene), 1,1-bis(4-dibenzylaminophenyl)propane, styrylanthracene, styrylpyrazoline, a phenylhydrazone compound, an α-phenylstilbene derivative, a thiazole derivative, a triazole derivative, a phenazine derivative, an acridine derivative, a benzofuran derivative, a benzimidazole derivative, a thiophene derivative, etc. These positive hole transport materials can be used alone or in combination.

In addition, the following polymeric charge transport materials can be used. Polymers having a carbazole ring such as poly-N-vinylcarbazole, polymers having a hydrazone structure disclosed in Japanese published unexamined application No. 57-78402, polysilylene compounds disclosed in Japanese Laid-Open Patent Publication No. 63-285552 and aromatic polycarbonates having formulae (1) to (6) disclosed in Japanese published unexamined application No. 2001-330973. These polymeric charge transport materials can be used alone or in combination. Particularly, the exemplified compounds disclosed in Japanese published unexamined application No. 2001-330973 are effectively used because of having good electrostatic properties.

The polymeric charge transport materials do not exude less from a CTL to a crosslinked surface layer than a low-molecular-weight charge transport material, and are suitable materials to prevent the crosslinked surface layer from being poorly cured. Further, the polymeric charge transport materials have good heat resistance and is not much affected with a heat curing the crosslinked surface layer.

Specific examples of the polymers for use as the binder resin of the CTL include thermoplastic resins and thermosetting resins such as polystyrene, polyester, polyarylate, polycarbonate, acrylic resins, silicone resins, fluorine-containing resins, epoxy resins, melamine resins, urethane resins, phenolic resins and alkyd resins. Particularly, polystyrene, polyester, polyarylate and polycarbonate are preferably used as a binder of a charge transport material because of their good charge transportability. Since a crosslinked surface layer is formed on a CTL, the CTL is not required to have a mechanical strength as a conventional CTL. Therefore, a material having high transparency but low mechanical strength such as polystyrene, which used to be difficult to use, can effectively be used as a binder for the CTL.

These polymeric compounds can be used alone or in combination. In addition, copolymers of the monomers of the polymer materials mentioned above can also be used. Further, copolymers of the monomers with a charge transport material can also be used.

When an electrically inactive polymer is used to reform a CTL, caldo polymer-type polyester; polyester such as polyethylenephthalate and polyethylenenaphthalate; polycarbonate formed of bisphenol-type polycarbonate, the phenol 3,3' portion of which is substituted by an alkyl group such as C-type polycarbonate; polycarbonate formed of bisphenol A, the geminal methyl group of which is substituted by a long-chain alkyl group having two or more carbon atoms; polycarbonate having a biphenyl or biphenyl ether skeleton; polycaprolactone; polycarbonate having a long-chain alkyl skeleton such as polycaprolactone disclosed in Japanese published unexamined application No. 7-292095; an acrylic resin; polystyrene and hydrogenated butadiene are effectively used.

The electrically inactive polymer means a polymer which does not have a structure having a photoconductive property, such as the triarylamine structure.

When these resins are used as an additive together with a binder resin, the content thereof is preferably not greater than 50% by weight in view of photosensitivity of the resultant photoreceptor.

When a low molecular weight charge transport material is used, a content thereof is preferably from 40 to 200 phr (parts per hundred of resin), and preferably from 70 to 100 phr.

When a charge transport polymer is used, a content thereof is preferably from 0 to 200 parts by weight, and preferably from 80 to 150 parts by weight, per 100 parts by weight of the charge transport components included therein.

When two or more kinds of charge transport materials are included in the CTL, the difference in ionization potential between the two or more kinds of charge transport materials is as small as possible, specifically the difference is preferably not greater than 0.10 eV. In this case, it is prevented that one of the charge transport materials serves as a trap of the other charge transport materials.

In addition, a charge transport material and an after-mentioned curable charge transport material included in a CTL preferably have a difference of 0.10 eV in ionization potential as well. The ionization potential in the present invention is measured by an atmospheric ultraviolet photoelectron analyzer AC-1 from Riken Keiki Co., Ltd. in a typical method.

To impart high photosensitivity to a photoreceptor, the content of the charge transport materials in the CTL is preferably not less than 70 phr. Suitable the charge transport materials include α-phenylstilbene compounds, benzidine compounds, monomers and dimmers of butadiene compounds and charge transport polymer materials having these structures in their main or side chains because of their high charge transportability.

Suitable solvents for use in the CTL coating liquid include ketone such as methyl ethyl ketone, acetone, methyl isobutyl ketone, and cyclohexanone; ethers such as dioxane, tetrahydrofuran, and ethyl cellosolve; aromatic solvents such as toluene, and xylene; halogen-containing solvents such as chlorobenzene, and dichloromethane; esters such as ethyl acetate and butyl acetate; etc. Particularly, methyl ethyl ketone, tetrahydrofuran and cyclohexanone are more preferably used than chlorobenzene, dichloromethane, toluene and xylene because of their low environmental burdens. These solvents can be used alone or in combination.

The CTL can be formed by dissolving or dispersing a mixture or a copolymer mainly formed of a charge transport material and a binder resin in a solvent to prepare a coating liquid; and coating and drying the coating liquid. Suitable coating methods include a dip coating method, a spray coating method, a ring coating method, a roll coating method, a gravure coating method, a nozzle coating method and a screen printing method.

The CTL preferably has a thickness of from 15 to 40 μm, and more preferably from 15 to 30 μm to have practically required sensitivity and chargeability.

The CTL can optionally include one or more additives such as antioxidants, plasticizers, lubricants and ultraviolet absorbents, if desired. Specific examples thereof are mentioned below. These additives are added in the CTL in an amount of from 0.1 to 20 phr, preferably from 0.1 to 10 phr. The leveling agents are added in an amount of from 0.001 to 0.1 phr.

The crosslinked surface layer is a protection layer formed on a photoreceptor. After a coating liquid is coated, a crosslinked layer is formed by a polycondensation reaction. The crosslinked surface layer has the highest abrasion resistance in each layer of a photoreceptor because of having a crosslinked structure. In addition, the layer has charge transportability similar to that of the CTL because of including a crosslinkable charge transport material.

In the present invention, the surface layer has a Martens hardness not less than 160 N/mm$^2$ and an elastic power not less than 35%. In addition, the photoreceptor does not have a residual potential larger than 300 v. Examples mentioned later satisfy these conditions.

Then electrophotographic photoreceptor of the photoreceptor includes a crosslinked surface layer including α-alumina and tin oxide, in which a first one-dimensional data array obtained from measuring a concavo-convex shape of the surface of the photoreceptor with a surface roughness/profile shape measurer is subjected to a first multiple image resolution analysis in which a wavelet conversion is made to the first one-dimensional data array to be separated into 6 frequency components; the one-dimensional data array of the lowest frequency component is further thinned so as to have 1/10 to 1/100 data arrays to obtain a second one-dimensional data array; the second one-dimensional data array is further subjected to a second multiple image resolution analysis in which the wavelet conversion is made to the second one-dimensional data array to be separated into additional 6 frequency components; and in arithmetic average roughness of the total 12 frequency components, at least WRa (LML) and WRa (LHH) have a folding point or a maximum point.

In the present invention, the surface layer preferably includes trimethylolpropanetriacrylate to prevent the image distortion due to the particulate tin oxide.

Trimethylolpropane fortifies the abrasion resistance of the surface of a photoreceptor.

As a tri- or more functional binder component, caprolactone-modified dipentaerythlitolhexaacrylate or dipentaerythlitolhexaacrylate is preferably included, which often improves the abrasion resistance and toughness of the crosslinked layer.

As a tri- or more functional radical polymerizablemonomer, trimethylolpropanetriacrylate, caprolactone-modified dipentaerythlitolhexaacrylate and dipentaerythlitolhexaacrylate are preferably used. These are available from reagent manufacturers such as Tokyo Chemical Industry Co., Ltd. and Nippon Kayaku Co., Ltd. marketing KAYARD DPCA series and DPHA series. In addition to this, a starter such as IRGACURE 184 from Ciba Speciality Chemicals may be added to the crosslinked surface layer in an amount of from 5 to 10% by weight based on total weight of solid contents therein. Crosslinkable charge transport materials include chain polymerization compounds having an acryloyloxy group and a styrene group and consecutive polymerization compounds having a hydroxyl group, an alkoxysilyl group and an isocyanate group. A compound including a charge transport structure and one or more (meth) acryloyloxy group can be used, and may include a monomer or a oligomer having one or more (meth) acryloyloxy group not including a charge transport structure. When preparing the crosslinked surface layer using a coating liquid including such a compound, the coating liquid is applied (or sprayed) on the surface of a photoreceptor to form a layer thereon, and then an energy such as heat and light or a radiation ray such as electron rays and y rays is applied thereto to crosslink the layer. For example, charge transport materials having the following formula (1) are preferably used.

(1)

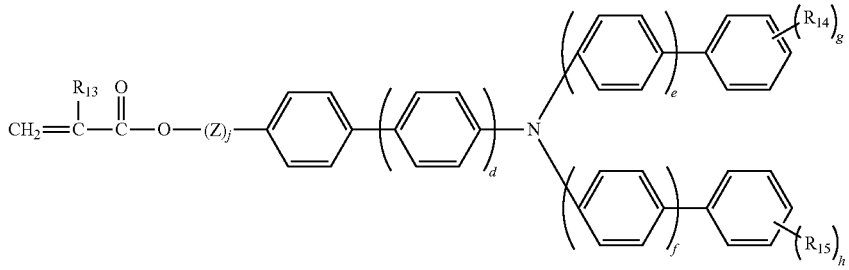

wherein d, e and f independently represent 0 or 1; g and h independently represent 0 or an integer of from 1 to 3; $R_{13}$ represents a hydrogen atom or a methyl group; each of $R_{14}$ and $R_{15}$ represents an alkyl group having from 1 to 6 carbon atoms, wherein when g is 2 or 3, the groups $R_{14}$ may be the same or different from each other, and when h is 2 or 3, the groups $R_{15}$ may be the same or different from each other; Z is a methylene group, an ethylene group or one of the following groups:

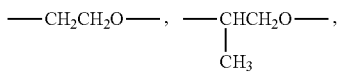

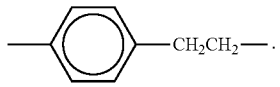

Specific examples of the compounds having formula (I) are as follows.

No. 1

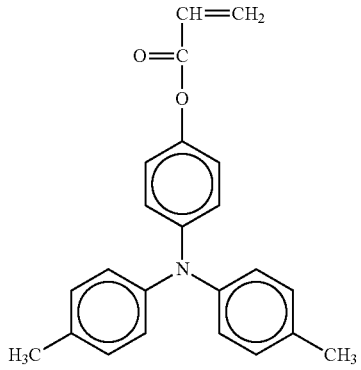

-continued

No. 2

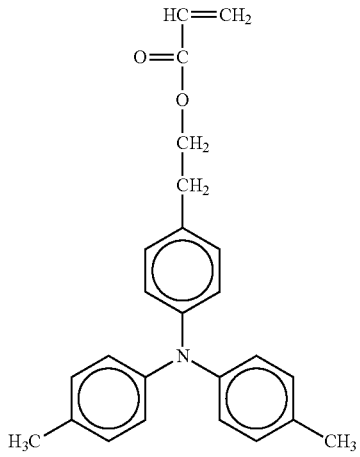

No. 3

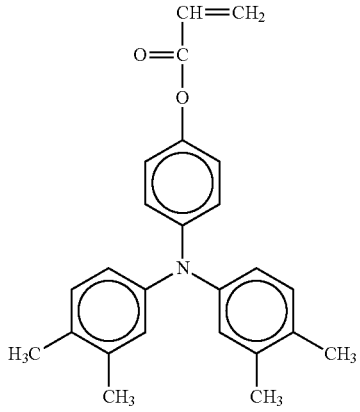

-continued
No. 4
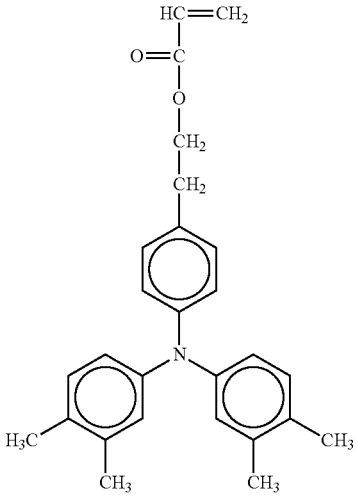
No. 5
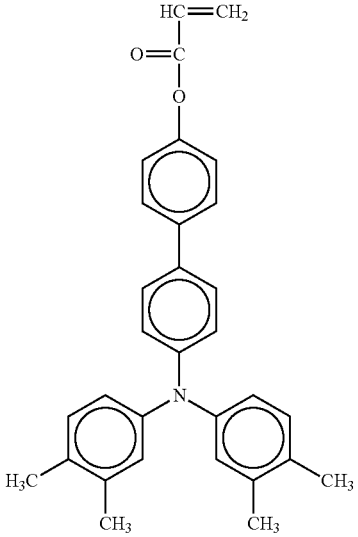
No. 6
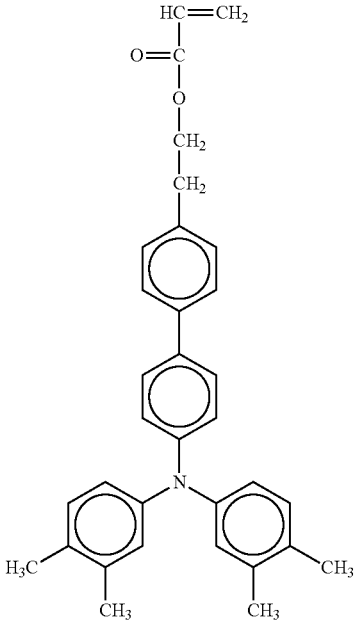
-continued
No. 7
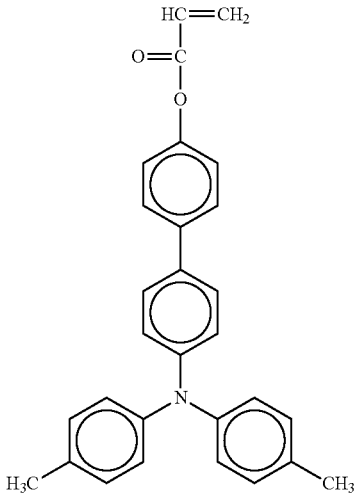
No. 8
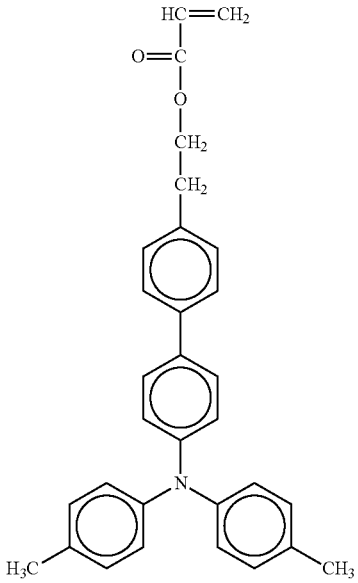

-continued
No. 9
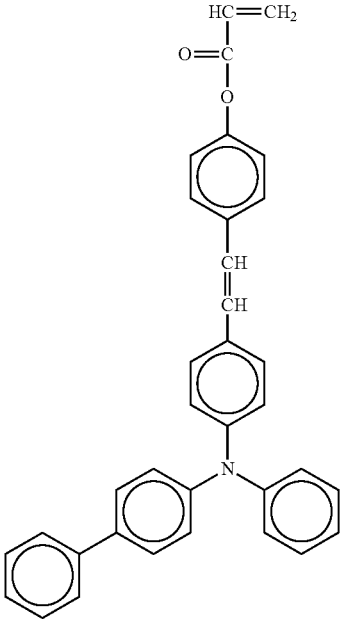
No. 10
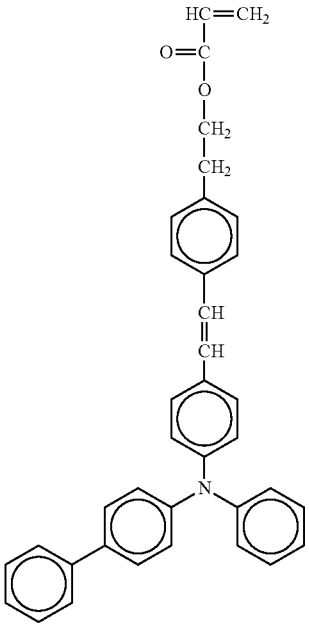
-continued
No. 11
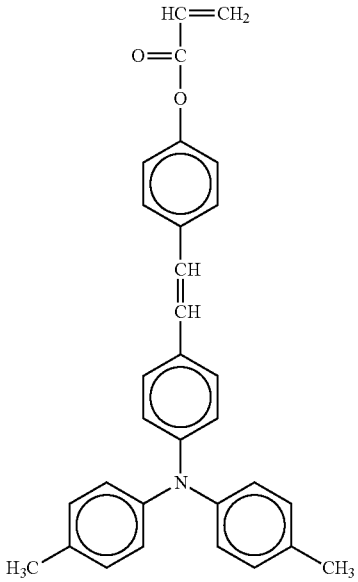
No. 12
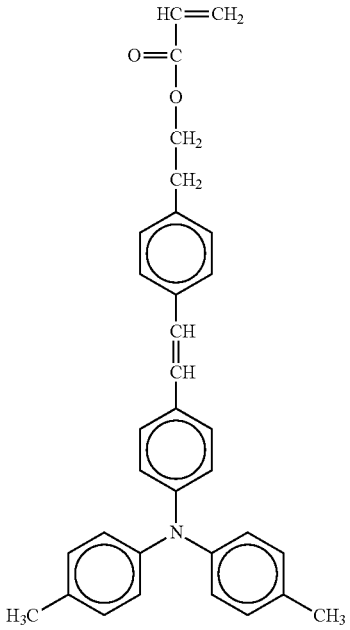

-continued
No. 13
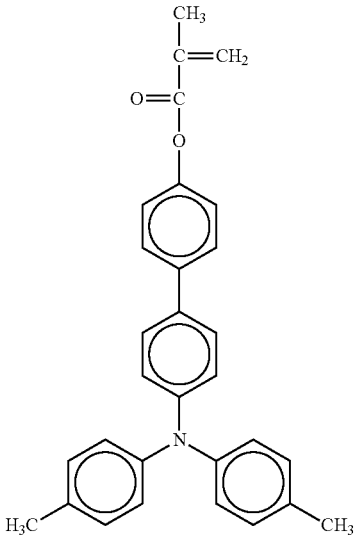
-continued
No. 15
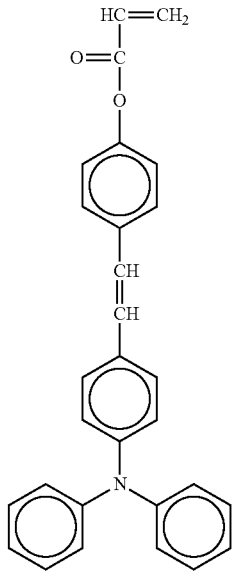
No. 14
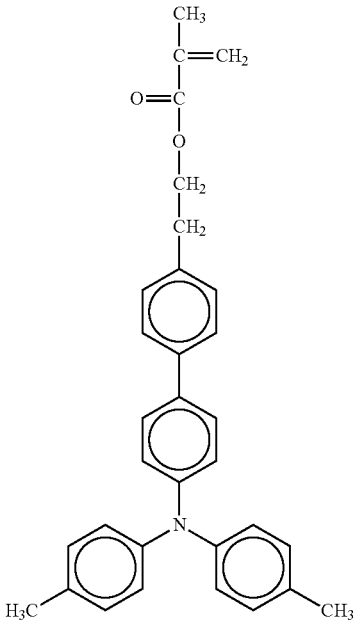
No. 16
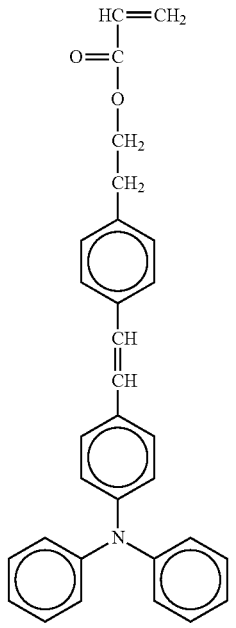

-continued
No. 17
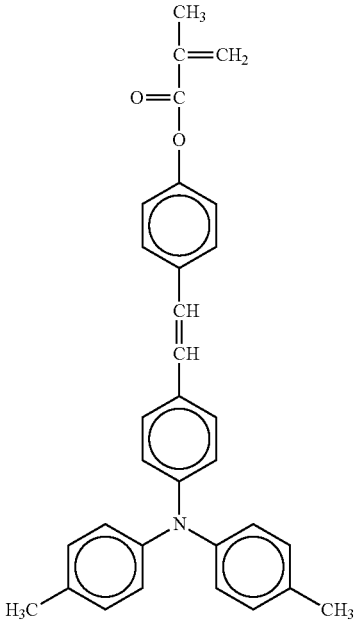
No. 18
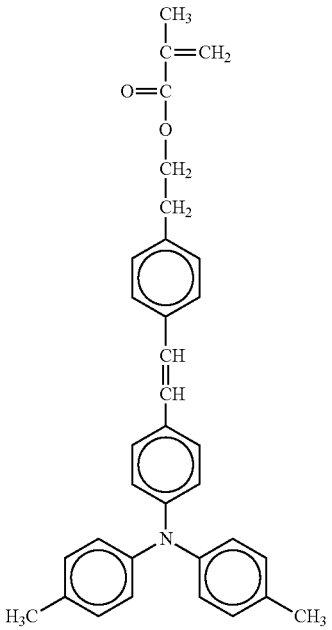
-continued
No. 19
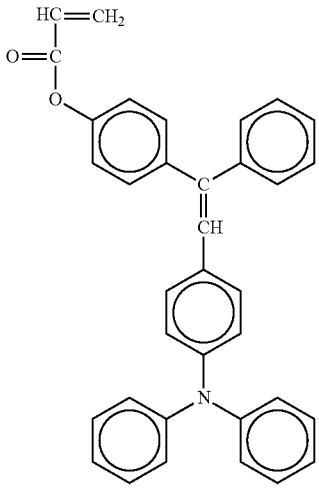
No. 20
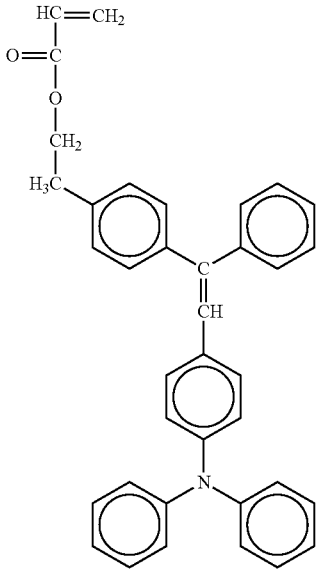
No. 21
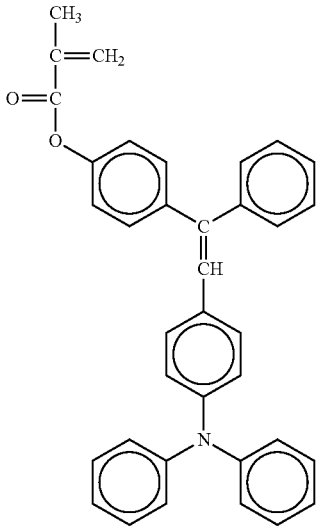

-continued
No. 22
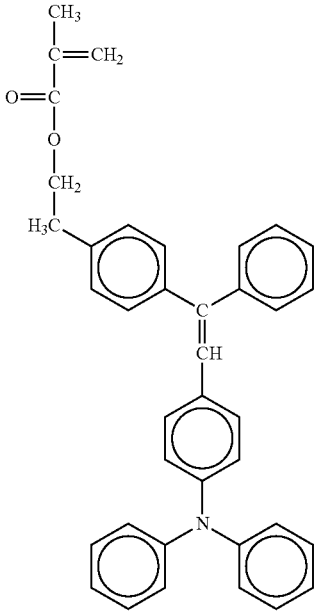
No. 23
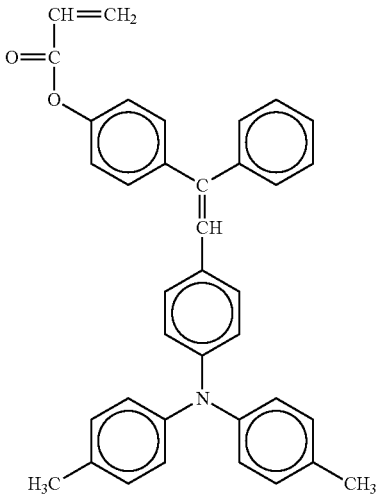
-continued
No. 24
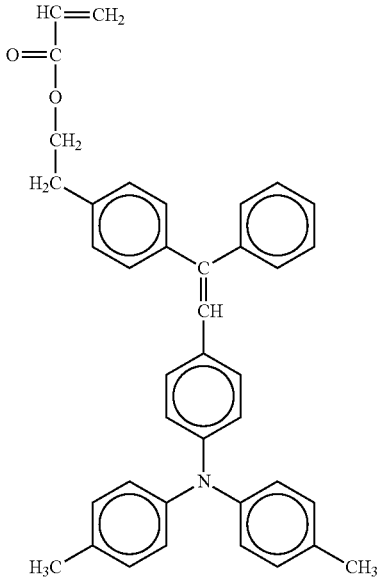
No. 25
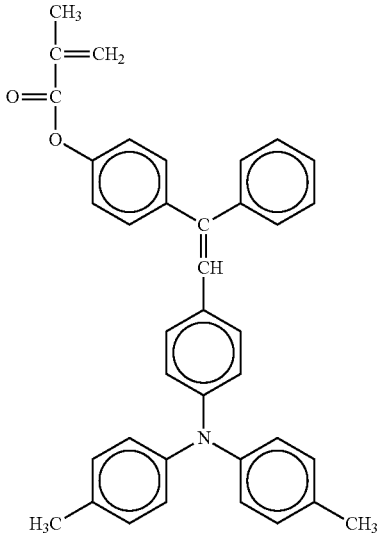

-continued

No. 26

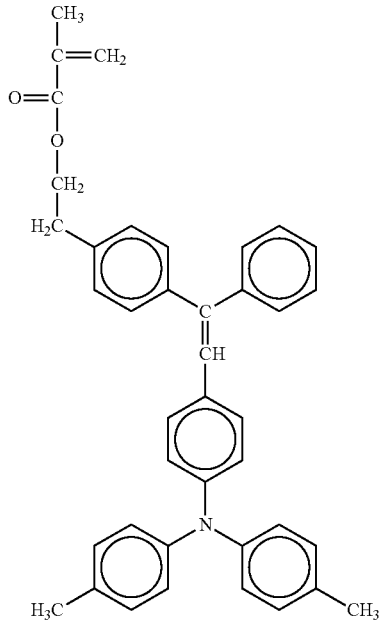

It is preferable that a dispersion solvent used for preparing the crosslinked surface layer coating liquid fully dissolves monomers, and specific examples thereof include ethers, aromatics, halogens, esters, cellosolves such as ethoxy ethanol and propylene glycols such as 1-methoxy-2-propanol. Methyl ethyl ketone, tetrahydrofuran, cyclohexanone and 1-methoxy-2-propanol are more preferably used than chlorobenzene, dichloromethane, toluene and xylene because of affecting the environment less. These solvents can be used alone or in combination.

Suitable coating methods of forming the crosslinked surface layer include a dip coating method, a spray coating method, a ring coating method, a roll coating method, a gravure coating method, a nozzle coating method and a screen printing method. In many cases, coating liquids do not have long pot lives, and therefore methods of performing necessary coating with a small amount of a coating liquid, i.e., the spray coating method and ring coat method are advantageously used in terms of environmental protection and cost.

UV irradiators such as high pressure mercury lamps and metal halide lamps having an emission wavelength of UV light can be used for forming the crosslinked surface layer. In addition, a visible light source adaptable to absorption wavelength of the radical polymerizing compounds and photo polymerization initiators can also be used. An irradiation light amount is preferably from 50 to 1,000 mW/cm$^2$. When less than 50 mW/cm$^2$, the curable reaction takes time. When greater than 1,000 mW/cm$^2$, the reaction nonuniformly proceeds, resulting in local wrinkles on the surface of crosslinked surface layer, and generation of a number of unreacted residues and reaction-ceased ends. Further, the rapid crosslinking enlarges an internal stress, resulting in cracks and peeling of the layer.

The crosslinked surface layer can optionally include one or more low-molecular-weight compounds and leveling agents such as antioxidants, plasticizers, lubricants and ultraviolet absorbents as CGL, and the polymeric compounds as CTL. These can be used alone or in combination. A combination of the low-molecular-weight compounds and the leveling agents The low-molecular-weight compounds often causes deterioration of the sensitivity of a photoreceptor. Therefore, these are preferably included in the crosslinked surface layer in an approximate amount of from 0.1 to 20% by weight, and more preferably from 0.1 to 10% by weight, based on total weight of solid contents in the coating liquid. The leveling agents are included therein in an approximate amount of from 0.1 to 5% by weight based thereon.

The crosslinked surface layer preferably has a thickness of from 3 to 15 μm. The minimum is on a cost-effective basis. The maximum is based on electrostatic properties such as charge stability and light attenuation sensitivity, and uniformity of the layer.

In the present invention, it is essential that WRa (LML) and WRa (LHH) have a folding point or a maximum point. Therefore, the surface of a photoreceptor needs roughening. Specific methods of roughening the surface thereof by adding materials expected to control the surface profile include adding a filler, a sol-gel coating liquid, polymers having different glass transition temperatures, an organic particulate material, a foaming material and a large amount of an silicone oil in a crosslinked surface layer. In addition, a large amount of water or liquids having different boiling points is added in a coating liquid to control conditions of forming the surface layer. Further, an organic solvent or water may be sprayed on a wet film just after the crosslinked surface layer is formed. Besides, after the resin surface layer is crosslinked, the surface may be ground by sand blast or with a grind paper such as lapping films.

Various methods can roughen the surface of a photoreceptor as mentioned above. However, it is not easy that WRa (LML) and WRa (LHH) have a folding point or a maximum point.

Controlling the film forming conditions can change concavities and convexities somewhat, but is unpractical due to high contingency.

In order to have WRa (LML) and WRa (LHH) have a folding point or a maximum point, a mixed filler including α-alumina having a hexagonal close-packed structure and tin oxide, and a filler dispersant having an amine value not less than 4 mg KOH/g are use. The dispersant is not use din general because of being likely to accumulate a residual potential of a photoreceptor. The effect of reducing an irradiated part potential of tin oxide neutralizes this, and a combination thereof is thought usable.

SUMICORUNDUM marketed from Sumitomo Chemical Co., Ltd. can be used as the α-alumina having a hexagonal close-packed structure, but is not limited thereto. NanoTek $SnO_2$ from C.I. KASEI CO., LTD. and S-1 and S-2000 from Mitsubishi Materials Electronic Chemicals Co., Ltd can be used as the tin oxide. Disper BYK series from BYK Chemie GmbH and DISPERLON series from KUSUMOTO CHEMICALS, Ltd. can be used as the dispersant.

Hereinafter, the image forming apparatus of the present invention will be explained, referring to the drawings.

The image forming apparatus of the present invention is equipped with an applicator applying a solid lubricant to the surface of a photoreceptor. The applicator will be explained later.

FIG. 1 is a schematic view illustrating an embodiment of the electrophotographic image forming apparatus of the present invention, and a modified embodiment as mentioned later belongs to a scope of the present invention.

In FIG. 1, a photoreceptor 11 is an electrophotographic photoreceptor including the crosslinked surface layer of the present invention. The photoreceptor 11 has the shape of a drum, and may have the shape of a sheet or an endless belt.

Any known chargers such as a corotron, a scorotron, a solid state charger and a charging roller can be used for a charger 12. A contact charger or a closely located charger to a photoreceptor is preferably used to decrease a power consumption. Particularly, the closely located charger to a photoreceptor, which has a proper gap therebetween is more preferably used to prevent a contamination of the charger. The above-mentioned chargers can be used as a transferer 16, and typically a combination of the transfer charger and separation charger is effectively used.

Suitable light sources for use in an imagewise light irradiator 13 and a discharger 1A include fluorescent lamps, tungsten lamps, halogen lamps, mercury lamps, sodium lamps, light emitting diodes (LEDs), laser diodes (LDs), light sources using electroluminescence (EL) and the like. In addition, in order to obtain light having a desired wavelength range, filters such as sharp-cut filters, band pass filters, near-infrared cutting filters, dichroic filters, interference filters, color temperature converting filters, etc. can be used.

When a toner image 15 formed on the photoreceptor by an image developer 14 is transferred onto an image receiving media 18, the toner image is not all transferred thereon, and a residual toner remains on the surface of the photoreceptor. The residual toner is removed by cleaner 17 from the photoreceptor. Suitable cleaners include a rubber cleaning blade and a brush such as a fur brush and a mag-fur brush.

When a photoreceptor positively or negatively charged is exposed to imagewise light, an electrostatic latent image having a positive or negative charge is formed thereon. When the latent image having a positive charge is developed with a toner having a negative charge, a positive image can be obtained. In contrast, when the latent image having a positive charge is developed with a toner having a positive charge, a negative image (i.e., a reversal image) can be obtained.

Figure 2:
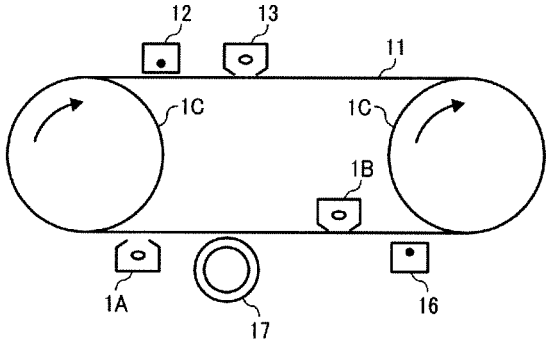
FIG. 2 is a schematic cross-sectional view illustrating another embodiment of the image forming apparatus of present invention.

FIG. 2 is a schematic view illustrating another embodiment of the electrophotographic image forming apparatus of the present invention. In FIG. 2, a photoreceptor 11 is an electrophotographic photoreceptor including the crosslinked resin surface layer of the present invention. The photoreceptor 11 has the shape of a drum, and may have the shape of a sheet or an endless belt. The photoreceptor 11 is driven by a driver 1C. Charging using a charger 12, imagewise light exposure using an irradiator 13, developing (not shown), transferring using a transferer 16, pre-cleaning irradiating using a pre-cleaning irradiator 1B, cleaning using a cleaner 17 and discharging using a discharger 1A are repeatedly performed. In FIG. 2, the pre-cleaning irradiating is performed from a side of a substrate of the photoreceptor. In this case, the substrate has to be light-transmissive.

The electrophotographic image forming apparatuses of the present invention are not limited to those shown in FIGS. 1 and 2. For example, although the pre-cleaning irradiating is performed from the substrate side in FIG. 2, the pre-cleaning light irradiating can be performed from a photosensitive layer side of the photoreceptor. In addition, irradiating in the imagewise light irradiation process and the discharge process may be performed from the substrate side of the photoreceptor. On the other hand, imagewise light irradiation, pre-cleaning irradiation and discharge irradiation are shown in FIGS. 1 and 2, and other known irradiations such as pre-transfer irradiation, pre-imagewise-light-irradiation irradiation can be performed.

Figure 3:
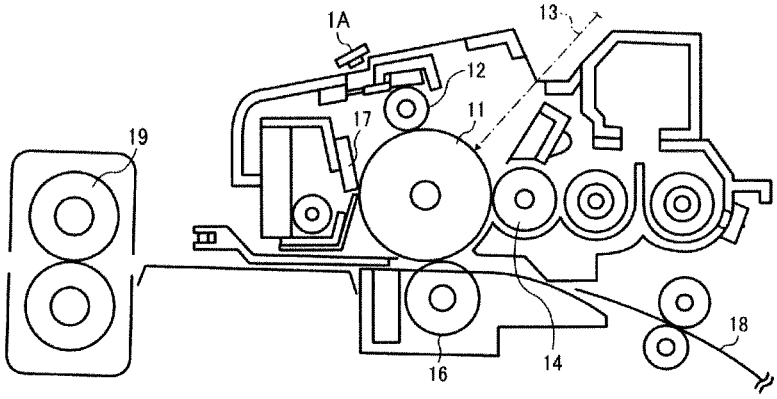
FIG. 3 is a schematic cross-sectional view illustrating a further embodiment of the image forming apparatus of present invention.

The above-mentioned electrophotographic image forming apparatuses may fixedly be set in a copier, a facsimile or a printer, and may be set therein as a process cartridge. The process cartridge in the present invention includes a photoreceptor, and at least one of a charger, an irradiator, an image developer, a transferer, a cleaner and a discharger. The process cartridge has many shapes, and an embodiment thereof is shown in FIG. 3. The photoreceptor 11 has the shape of a drum, and may have the shape of a sheet or an endless belt.

Figure 4:
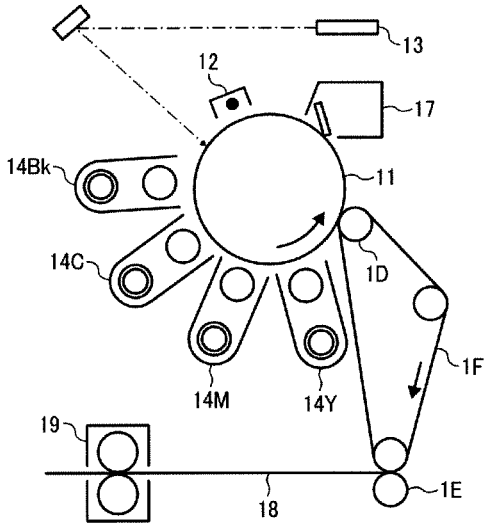
FIG. 4 is a schematic cross-sectional view illustrating another embodiment of the image forming apparatus of present invention.

FIG. 4 is a schematic view illustrating a further embodiment of the electrophotographic image forming apparatus of the present invention. The electrophotographic image forming apparatus includes a photoreceptor 11; and a charger 12, 1*n* irradiator 13, image developers 14Bk, 14C, 14M and 14Y for each color toner of black (Bk), cyan (C), magenta (M) and yellow (Y), an intermediate transfer belt 1F as an intermediate transferer and a cleaner 17 around the photoreceptor. The photoreceptor 11 is an electrophotographic photoreceptor including the crosslinked resin surface layer of the present invention; The image developers 14Bk, 14C, 14M and 14Y can independently be controlled, and only the image developer forming a color is driven. A toner image formed on the photoreceptor 11 is transferred onto an intermediate transfer belt 1F by a first transferer 1D located inside the intermediate transfer belt 1F. The first transferer 1D is located so as to be capable of contacting and releasing from the photoreceptor 11, and contacts the intermediate transfer belt 1F to the photoreceptor 11 only when transferring a toner image. After each color toner image layered on the intermediate transfer belt 1F is transferred onto an image receiving media 18 at a time by a second transferer 1E, the toner image is fixed thereon by a fixer 19. The second transferer 1E is also located so as to be capable of contacting and releasing from the photoreceptor 11, and contacts the intermediate transfer belt 1F to the photoreceptor 11 only when transferring a toner image.

While an electrophotographic image forming apparatus using a transfer drum cannot print on a thick paper because a transfer material electrostatically sticks to the transfer drum, the electrophotographic image forming apparatus using an intermediate transferer in FIG. 4 does not have a limit of the transfer material because each color toner image is layered on the intermediate transfer belt 1F. Such an intermediate transferer can be applied not only to the apparatus in FIG. 6 but also to the apparatuses in FIGS. 1 to 3, 5 and 6 mentioned later.

Figure 5:
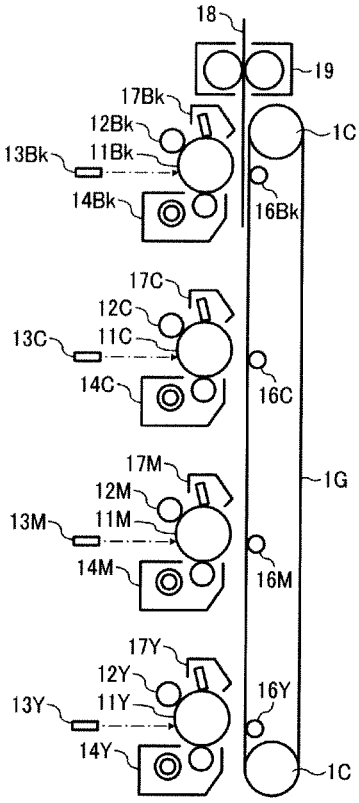
FIG. 5 is a schematic cross-sectional view illustrating a further embodiment of the image forming apparatus of present invention.
Figure 6:
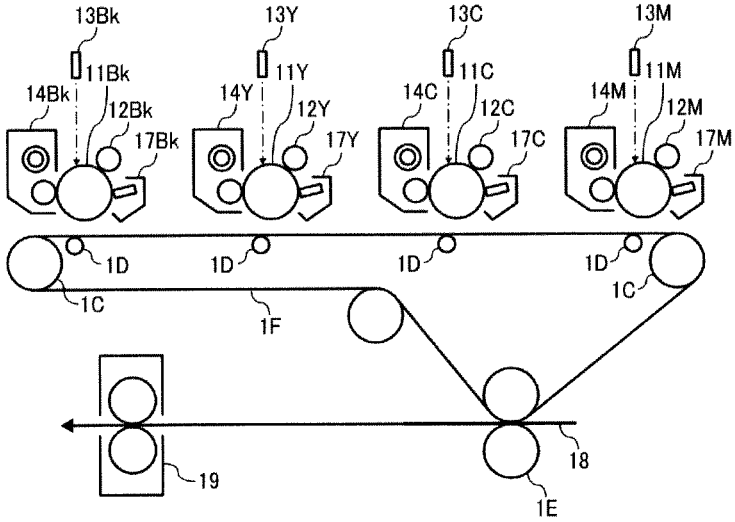
FIG. 6 is a schematic cross-sectional view illustrating another embodiment of the image forming apparatus of present invention.

FIG. 5 is a schematic view illustrating another embodiment of the electrophotographic image forming apparatus of the present invention. This electrophotographic image forming apparatus uses four color toners, i.e., a yellow (Y) toner, a magenta (M) toner, cyan (C) toner and black (Bk) toner, and has image forming units and photoreceptors 11Y, 11M, 11C and 11Bk for each color. The photoreceptor 11 is an electrophotographic photoreceptor including the crosslinked resin surface layer of the present invention. Around each of the photoreceptors 11Y, 11M, 11C and 11Bk, a charger 12, an irradiator 13, an image developer 14 and a cleaner 17, etc. are located. A transport transfer belt 1G as a transfer material bearer contacting and leaving from each transfer position of each photoreceptor 11Y, 11M, 11C and 11Bk is hung over a driver 1C. A transferer 16 is located at a transfer position opposite to each of the photoreceptors 11Y, 11M, 11C and 11Bk across the transport transfer belt 1G.

The electrophotographic image forming apparatus as shown in FIG. 5 has photoreceptors 11Y, 11M, 11C and 11Bk for each color and sequentially transfer each color toner image onto an image receiving media 18 borne by the transport transfer belt 1G, and therefore can produce full-color images at a far higher-speed than that of a full-color image forming apparatus having only one photoreceptor.

Figure 9:
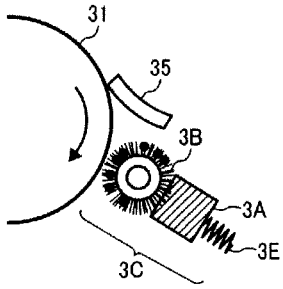
FIG. 9 is a schematic cross-sectional view illustrating a means of applying a solid lubricant to a photoreceptor.

A lubricant applicator 3C is installed in the image forming apparatus of the present invention as a lubricant feeing unit applying a lubricant 3A to the surface of a photoreceptor as shown in FIG. 9. The lubricant applicator has a fur brush 3B as an application member, the solid lubricant 3A, and a pressure spring 3D pressing the lubricant in a direction of the fur brush. The solid lubricant 3A is a bar-formed solid lubricant. The fur brush 3B contacts its end to the surface of a photoreceptor, axially rotates to scrape up the solid lubricant 3A, and transfers the lubricant to a position contacting the surface of the photoreceptor to apply the lubricant thereto. In the present invention, as a condition realizing good solid lubricant coatability, it is important for the photoreceptor to have a linear speed such that 250 to 1,000 concavities and convexities thereof in a dominant frequency component pass an application blade.

Even when the solid lubricant 3A is scraped off by the fur brush 3B and reduced, the pressure spring 3D presses the solid lubricant 3A toward the fur brush 3B. Therefore, the solid lubricant 3A is evenly scraped up by the fur brush 3B at all times.

In addition, a solid lubricant fixing unit increasing fixability of the solid lubricant adhering to the surface of a photoreceptor may be located. The unit is a plate like a cleaning blade pressed to the photoreceptor in a trailing or a counter direction.

Specific examples of the solid lubricant 3A include metal salts of fatty acid such as lead oleate, zinc oleate, copper oleate, zinc stearate, cobalt stearate, iron stearate, copper stearate, zinc palmitate, copper palmitate and zinc linolenate; and fluorine-containing resins such as polytetrafluoroethylene, polychlorotrifluoroethylene, polytetrafluoroethylene, polychlorotrifluoroethylene, polyvinylidene fluoride, polytrifluorochlorethylene, dichlorodifluoroethylene, tetrafluoroethylene-ethylene copolymers and tetrafluoroethylene-oxafluoropropylene copolymers. Particularly, metallic stearate is preferably used, and zinc stearate is more preferably used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, the test and measurement methods in the present invention will be explained.

(1) Measurement of Surface Profile of Photoreceptor

Text data of a profile curve of a photoreceptor were recorded using a surface roughness/profile shape measurer Surfcom 1400D from Tokyo Seimitsu Co., Ltd., with a pickup E-DT-S02A at a measurement length of 12 mm, a measurement speed of 0.06 mm/s and a sampling interval of 0.39 μm. The data was subjected to a multiple image resolution analysis by a wavelet conversion to be separated into 6 frequency components of from 0 to 3, 1 to 6, 2 to 13, 4 to 25, 10 to 50 and 24 to 99 μm, each of which is one cyclic length. Data arrays of the lowest frequency component having one cyclic length of 24 to 99 μm are thinned to prepare a one-dimensional data array. The one-dimensional data array is further subjected to a multiple image resolution analysis by a wavelet conversion to be separated into 6 frequency components of from 26 to 106, 53 to 183, 106 to 318, 214 to 551, 431 to 954 and 867 to 1, 654 μm, each of which is one cyclic length. Four places on a photoreceptor were measured. An average of surface roughness parameters of the 4 places was determined as WRa (μm) of the respective frequency components. A mother wavelet function was Haar and the lowest frequency component is thinned to 1/40.

(2) Image Evaluation

Each 5 halftone patterns in which 4 dots×4 dots are printed in a matrix 8×8 at a pixel density of 600 dpi×600 dpi and blank patterns were alternately and continuously produced to visually evaluate background fouling of the blank patterns under the following standard.

5: Very good
4: Good
3: No problem
2: Slightly gray, but practically no problem
1: Gray

Example 1

An undercoat layer coating liquid, a CGL coating liquid and a CTL coating liquid having the following compositions respectively were coated in this order on an aluminum drum having a thickness of 0.8 mm, a length of 340 mm and an outer diameter of 40 mm and then dried to form an undercoat layer having a thickness of 3.5 μm and overlying aluminum drum, a CGL having a thickness of 0.2 μm and overlying the undercoat layer, and a CTL having a thickness of 24 μm and overlying the CGL. Further, after a crosslinked surface layer coating liquid having the following composition was sprayed on the CTL, the surface layer was irradiated with UV light from UV curing lamp to be cured at a luminance of 600 mW/cm$^2$ hen measured by an UV integral actinometer UIT-150 from Ushio, Inc. and at a distance of 112 mm while the drum was rotated at 55 rpm. While the surface layer was irradiated continuously with UV light for 4 min, water having a temperature of 30° C. was circulated in the aluminum drum. After cured, the surface layer was heated and dried at 130° C. for 30 min to form a crosslinked surface layer having a thickness of 5 μm on the CTL. Thus, an electrophotographic photoreceptor was prepared.

The crosslinked surface layer coating liquid was prepared as follows.

First, a dispersion including a mixed filler having a solid dispersion concentration of 10% by weight and tetrahydrofuran was dispersed with partially-stabilized zirconia (PSZ) for 2 hrs by a vibration shaker from IKA® Japan K.K. Separately, a vehicle excluding a silicon-containing particulate component from the following crosslinked surface layer coating liquid having a proper concentration was prepared. The vehicle was added to the dispersion including the mixed filler.

| [Undercoat layer coating liquid] | |
|---|---|
| Alkyd resin solution<br>(BEKKOLITE M6401-50 from Dainippon Ink & Chemicals, Inc. ) | 12 |
| Melamine resin solution<br>(SUPER BEKKAMIN G-821-60 from Dainippon Ink & Chemicals, Inc.) | 8 |
| Titanium dioxide<br>(CR-EL from Ishihara Sangyo Kaisha Ltd.) | 40 |
| Methyl ethyl ketone | 200 |

-continued

[CGL coating liquid]

Bisazo pigment having the following formula: 5
(from Ricoh Company, Ltd.)

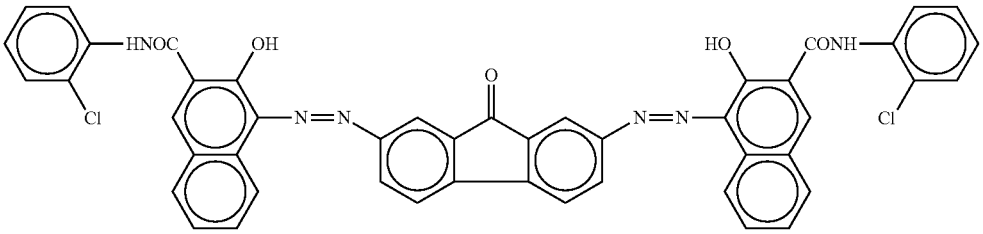

Polyvinyl butyral 1
(XYHL from Union Carbide Corp.)
Cyclohexanone 200
Methyl ethyl ketone 80

[CTL coating liquid]

Z-type polycarbonate 10
(Panlite TS-2050 from TEIJIN CHEMICALS LTD.)
Low-molecular-weight charge transport material having the following formula: 7

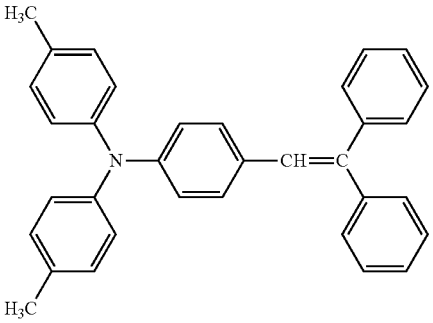

Tetrahydrofuran 100
1% silicone oil solution in tetrahydrofuran 1
(KF50-100CS from Shin-Etsu Chemical Industry Co., Ltd.)

[Crosslinked resin surface layer coating liquid]

Crosslinked charge transport material having the following formula: 43

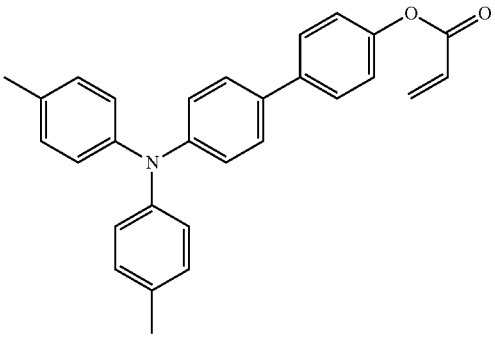

Trimethylolpropanetriacrylate 21
(KAYARAD TMPTA from Nippon Kayaku Co., Ltd.)
Caprolactone-modified dipentaerythritolhexaacrylate 21
(KAYARAD DPCA-120 from Nippon Kayaku Co., Ltd.)
Mixture of Polyester-modified Polydimethylsiloxane and propoxy-modified-2-neopentylglycoldiacrylate 0.2
(BYK-UV3570 from BYK-Chemie GmbH)
1-hydroxy-cyclohexyl-phenyl-ketone 4
(IRGACURE 184 from Ciba Specialty Chemicals)
α-alumina 8
(AA-03 from Sumitomo Chemical Co., Ltd. )
Tin oxide 1
(Nanotek $SnO_2$ from C.I. KASEI CO., LTD.)

-continued

| | |
|---|---|
| Dispersant<br>(BYK-P104 having a solid concentration of 50% and an acid value of 180 mg KOH/g from BYK-Chemie GmbH) | 1.8 |
| Tetrahydrofuran | 567 |

Example 2

The procedure for preparation of the electrophotographic photoreceptor in Example 1 was repeated except for changing the contents of α-alumina and tin oxide in the crosslinked surface layer coating liquid into 6 and 3, respectively.

Example 3

The procedure for preparation of the electrophotographic photoreceptor in Example 1 was repeated except for changing the crosslinked surface layer coating liquid into one having the following formula.

| | |
|---|---|
| Crosslinked charge transport material having the following formula: | 43 |

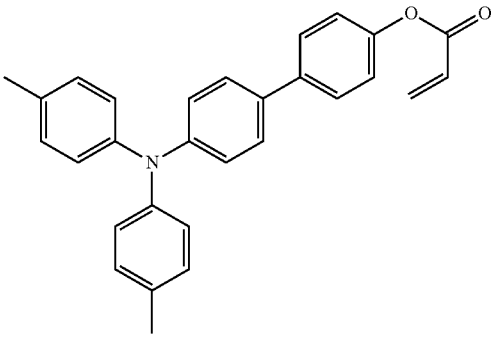

| | |
|---|---|
| Trimethylolpropanetriacrylate<br>(KAYARAD TMPTA from Nippon Kayaku Co., Ltd.) | 21 |
| Caprolactone-modified dipentaerythritolhexaacrylate<br>(KAYARAD DPCA-120 from Nippon Kayaku Co., Ltd.) | 21 |
| Mixture of Polyester-modified Polydimethylsiloxane and propoxy-modified-2-neopentylglycoldiacrylate<br>(BYK-UV3570 from BYK-Chemie GmbH) | 0.2 |
| 1-hydroxy-cyclohexyl-phenyl-ketone<br>(IRGACURE 184 from Ciba Specialty Chemicals) | 4 |
| α-alumina<br>(AA-03 from Sumitomo Chemical Co., Ltd.) | 6 |
| Tin oxide<br>(Nanotek $SnO_2$ from C.I. KASEI CO., LTD.) | 3 |
| Dispersant<br>(Disper BYK-2000 having a solid concentration of 40% and an amine value of 4 mg KOH/g from BYK-Chemie GmbH) | 2.25 |
| Tetrahydrofuran | 567 |

Example 4

The procedure for preparation of the electrophotographic photoreceptor in Example 3 was repeated except for changing the contents of α-alumina and tin oxide in the crosslinked surface layer coating liquid into 4 and 4, respectively.

Example 5

The procedure for preparation of the electrophotographic photoreceptor in Example 3 was repeated except for changing the contents of α-alumina and tin oxide in the crosslinked surface layer coating liquid into 3 and 7, respectively.

Example 6

The procedure for preparation of the electrophotographic photoreceptor in Example 3 was repeated except for changing the contents of α-alumina and tin oxide in the crosslinked surface layer coating liquid into 1 and 8, respectively.

Comparative Example 1

The procedure for preparation of the electrophotographic photoreceptor in Example 1 was repeated except for changing the crosslinked surface layer coating liquid into one having the following formula.

| | |
|---|---|
| Crosslinked charge transport material having the following formula: | 43 |

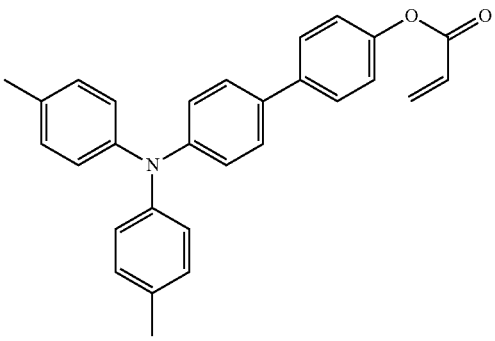

| | |
|---|---|
| Trimethylolpropanetriacrylate<br>(KAYARAD TMPTA from Nippon Kayaku Co., Ltd.) | 21 |
| Caprolactone-modified dipentaerythritolhexaacrylate<br>(KAYARAD DPCA-120 from Nippon Kayaku Co., Ltd.) | 21 |
| Mixture of Polyester-modified Polydimethylsiloxane and propoxy-modified-2-neopentylglycoldiacrylate<br>(BYK-UV3570 from BYK-Chemie GmbH) | 0.2 |
| 1-hydroxy-cyclohexyl-phenyl-ketone<br>(IRGACURE 184 from Ciba Specialty Chemicals) | 4 |
| α-alumina<br>(AA-03 from Sumitomo Chemical Co., Ltd.) | 9 |
| Dispersant<br>(BYK-P104 having a solid concentration of 50% and an acid value of 180 mg KOH/g from BYK-Chemie GmbH) | 1.8 |
| Tetrahydrofuran | 567 |

Comparative Example 2

The procedure for preparation of the electrophotographic photoreceptor in Comparative Example 1 was repeated except for replacing α-alumina with tin oxide (Nanotek $SnO_2$ from C.I. KASEI CO., LTD.).

Comparative Example 3

The procedure for preparation of the electrophotographic photoreceptor in Example 1 was repeated except for changing the crosslinked surface layer coating liquid into one having the following formula.

Crosslinked charge transport material having the following formula: 43

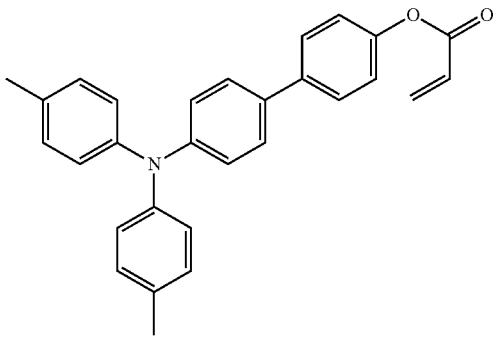

| | |
|---|---|
| Trimethylolpropanetriacrylate (KAYARAD TMPTA from Nippon Kayaku Co., Ltd.) | 21 |
| Caprolactone-modified dipentaerythritolhexaacrylate (KAYARAD DPCA-120 from Nippon Kayaku Co., Ltd.) | 21 |
| Mixture of Polyester-modified Polydimethylsiloxane and propoxy-modified-2-neopentylglycoldiacrylate (BYK-UV3570 from BYK-Chemie GmbH) | 0.2 |
| 1-hydroxy-cyclohexyl-phenyl-ketone (IRGACURE 184 from Ciba Specialty Chemicals) | 4 |
| α-alumina (AA-03 from Sumitomo Chemical Co., Ltd.) | 4 |
| Tin oxide (Nanotek $SnO_2$ from C.I. KASEI CO., LTD.) | 4 |
| Dispersant (BYK-P104 having a solid concentration of 50% and an acid value of 180 mg KOH/g from BYK-Chemie GmbH) | 0.4 |
| Tetrahydrofuran | 567 |

Comparative Example 4

The procedure for preparation of the electrophotographic photoreceptor in Example 3 was repeated except for changing the content of the dispersant into 0.8.

Comparative Example 5

The procedure for preparation of the electrophotographic photoreceptor in Example 3 was repeated except for changing the content of the dispersant into 1.6.

Comparative Example 6

The procedure for preparation of the electrophotographic photoreceptor in Example 5 was repeated except for changing the contents of α-alumina and tin oxide in the crosslinked surface layer coating liquid into 3 and 7, respectively.

Comparative Example 7

The procedure for preparation of the electrophotographic photoreceptor in Example 1 was repeated except for changing the crosslinked surface layer coating liquid into one having the following formula.

Crosslinked charge transport material having the following formula: 47

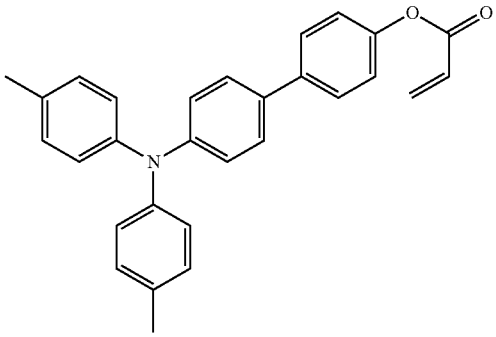

| | |
|---|---|
| Trimethylolpropanetriacrylate (KAYARAD TMPTA from Nippon Kayaku Co., Ltd.) | 23 |
| Caprolactone-modified dipentaerythritolhexaacrylate (KAYARAD DPCA-120 from Nippon Kayaku Co., Ltd.) | 23 |
| Mixture of Polyester-modified Polydimethylsiloxane and propoxy-modified-2-neopentylglycoldiacrylate (BYK-UV3570 from BYK-Chemie GmbH) | 0.2 |
| 1-hydroxy-cyclohexyl-phenyl-ketone (IRGACURE 184 from Ciba Specialty Chemicals) | 5 |
| Tetrahydrofuran | 567 |

The photoreceptor drums prepared in Examples 1 to 6 and Comparative Examples 1 to 7 were installed in a black development station of IPSiO SP C811 from Ricoh Company, Ltd., and 50,000 images were produced using a polymerization toner on My Paper A4 from NBS Ricoh Co., Ltd. under the condition of alternately and continuously printing each 5 halftone patterns in which 4 dots×4 dots are printed in a matrix 8×8 at a pixel density of 600 dpi×600 dpi and blank patterns.

A genuine photoreceptor unit was used. A voltage applied to a charging roller included an AC component having a voltage between peaks of 1.5 kV and a frequency of 0.9 kHz, and a DC component having a bias such that the photoreceptor had an initial charged potential of −700 V, which was kept till the end of the test. The developing bias was −500 V. A discharger was not available. Cleaners were replaced with brand-new genuine cleaners every time after 50,000 images were produced. After the test, a color test chart was printed on a PPC paper TYPE-6200A3.

The test was made at 25° C. and 55% RH.

Roughness spectra of the electrophotographic photoreceptors prepared in Examples 1 to 6 and Comparative Examples 1 to 7 are shown in FIGS. 28 to 33 and 34 to 41, respectively. WRa of each band frequency is shown in Tables 2-1 and 2-2.

In FIGS. 28 to 33 covering Examples 1 to 6, each WRa of LML and LHH has a folding point or a maximum point. However, that of LML and LHH in FIGS. 34 to 41 covering Comparative Examples 1 to 7 does not.

TABLES 2-1

| | WRa (μm) | | | | | |
|---|---|---|---|---|---|---|
| | HHH | HHL | HMH | HML | HLH | HLL |
| Example 1 | 0.00458 | 0.00272 | 0.00204 | 0.00211 | 0.00336 | 0.21875 |
| Example 2 | 0.00426 | 0.00298 | 0.00191 | 0.00231 | 0.00393 | 0.14120 |
| Example 3 | 0.00459 | 0.0029 | 0.00214 | 0.00290 | 0.00503 | 0.11315 |
| Example 4 | 0.00457 | 0.00258 | 0.00200 | 0.00328 | 0.00724 | 0.26425 |
| Example 5 | 0.00447 | 0.00266 | 0.00223 | 0.00268 | 0.00559 | 0.25108 |
| Example 6 | 0.00454 | 0.00275 | 0.00218 | 0.00264 | 0.00661 | 0.17350 |
| Comparative | 0.00459 | 0.00270 | 0.00210 | 0.00422 | 0.00787 | 0.10675 |

TABLES 2-1-continued

| | WRa (μm) | | | | | |
|---|---|---|---|---|---|---|
| | HHH | HHL | HMH | HML | HLH | HLL |
| Example 1 | | | | | | |
| Comparative Example 2 | 0.00457 | 0.00294 | 0.00219 | 0.00392 | 0.00824 | 0.20075 |
| Comparative Example 3 | 0.00456 | 0.00268 | 0.00201 | 0.00363 | 0.00580 | 0.17180 |
| Comparative Example 4 | 0.00436 | 0.00261 | 0.00193 | 0.00231 | 0.00388 | 0.08650 |
| Comparative Example 5 | 0.00432 | 0.00274 | 0.00197 | 0.00298 | 0.00606 | 0.06423 |
| Comparative Example 6 | 0.00445 | 0.00289 | 0.00214 | 0.00397 | 0.00750 | 0.11688 |
| Comparative Example 7 | 0.00456 | 0.00293 | 0.00183 | 0.00176 | 0.00165 | 0.23250 |

TABLES 2-2

| | WRa (μm) | | | | | |
|---|---|---|---|---|---|---|
| | LHH | LHL | LMH | LML | LLH | LLL |
| Example 1 | 0.00711 | 0.00598 | 0.00821 | 0.02383 | 0.05638 | 0.12750 |
| Example 2 | 0.00650 | 0.00596 | 0.00945 | 0.02938 | 0.05030 | 0.10280 |
| Example 3 | 0.00860 | 0.00771 | 0.01318 | 0.04873 | 0.07435 | 0.10220 |
| Example 4 | 0.01073 | 0.00973 | 0.02840 | 0.09333 | 0.10793 | 0.17588 |
| Example 5 | 0.00925 | 0.00705 | 0.02158 | 0.05893 | 0.08123 | 0.10855 |
| Example 6 | 0.01083 | 0.00901 | 0.02648 | 0.06573 | 0.06615 | 0.13525 |
| Comparative Example 1 | 0.01320 | 0.00843 | 0.00635 | 0.00966 | 0.02718 | 0.08868 |
| Comparative Example 2 | 0.00957 | 0.00822 | 0.01164 | 0.02628 | 0.05298 | 0.11988 |
| Comparative Example 3 | 0.01158 | 0.00858 | 0.00637 | 0.00621 | 0.02095 | 0.12200 |
| Comparative Example 4 | 0.00774 | 0.00665 | 0.00611 | 0.00836 | 0.03340 | 0.11738 |
| Comparative Example 5 | 0.01110 | 0.00751 | 0.00708 | 0.01790 | 0.04478 | 0.08295 |
| Comparative Example 6 | 0.01463 | 0.01004 | 0.00752 | 0.01443 | 0.03563 | 0.13600 |
| Comparative Example 7 | 0.00127 | 0.00208 | 0.00311 | 0.00439 | 0.02560 | 0.12128 |

TABLE 3

| | Image Evaluation | |
|---|---|---|
| | Rank | Result of Observation |
| Example 1 | 2 | Image density was slightly low |
| Example 2 | 3 | Toner slightly scraped out, but practically no problem |
| Example 3 | 5 | Good |
| Example 4 | 4 | Slight uneven coating of solid lubricant |
| Example 5 | 5 | Good |
| Example 6 | 2 | Slightly blurred images were produced due to scrape scratch |
| Comparative Example 1 | 1 | Image density was slightly low |
| Comparative Example 2 | 1 | Blurred images were produced due to scrape scratch |
| Comparative Example 3 | 1 | Abnormal images were produced due to poor cleaning |
| Comparative Example 4 | 1 | Abnormal images were produced due to poor cleaning |
| Comparative Example 5 | 1 | Abnormal images were produced due to poor cleaning |
| Comparative Example 6 | 1 | Abnormal images were produced due to poor cleaning |
| Comparative Example 7 | 1 | Abnormal images were produced due to poor cleaning |

The electrophotographic photoreceptors prepared in Examples 1 to 6 have a folding point at LML band frequency and can produce higher quality images than those prepared in Comparative Examples 1 to 7. The surface profile largely differs due to a dispersant included in the crosslinked surface layer, which is thought to affect the image quality. The printed image quality differs in many cases even when a mixing ratio of the fillers is same.

In the present invention, an electrophotographic photoreceptor needs a proper rough surface profile for a solid lubricant to adhere thereto. Surface of the electrophotographic photoreceptor is roughened for a powder of the solid lubricant scraped by an application brush not to sideslip and for an application blade to have a proper liner pressure variation. The former is made by a concave and convex shape of a high frequency component, which is formed on the electrophotographic photoreceptor. The latter is made by a concave and convex shape of a low frequency component, which is formed thereon. The photoreceptor having a proper concave and convex shape can produce high-definition images.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2010-032002, filed on Feb. 17, 2010, the entire contents of which are herein incorporated by reference.

What is claimed is:

1. An electrophotographic photoreceptor, comprising:

an electroconductive substrate;

a photosensitive layer overlying the substrate; and a crosslinked surface layer comprising α-alumina and tin oxide, overlying the photosensitive layer, wherein a first one-dimensional data array obtained from measuring a concavo-convex shape of the surface of the photoreceptor with a surface roughness/profile shape measurer is subjected to a first multiple image resolution analysis in which a wavelet conversion is performed on the first one-dimensional data array to separate the first one-dimensional data array into 6 frequency components, HHH, HHL, HMH, HML, HLH and HLL, each having single-cycle lengths of a concavity and a convexity of from 0 to 3, 1 to 6, 2 to 13, 4 to 25, 10 to 50 and 24 to 99 μm, respectively, the one-dimensional data array of the frequency component HLL is further thinned so as to have 1/40data arrays to obtain a second one-dimensional data array, the second one-dimensional data array is further subjected to a second multiple image resolution analysis in which the wavelet conversion is performed on the second one-dimensional data array to separate the second one-dimensional data array into 6 additional frequency components, LHH, LHL, LMH, LML, LLH and LLL, each having single-cycle lengths of a concavity and a convexity of from 26 to 106, 53 to 183, 106 to 318, 214 to 551, 431 to 954 and 867 to 1,654 μm, respectively, and wherein when relationships between respective arithmetic average roughness (WRa) (y-axis) of the 12 frequency components and the frequency components (x-axis) are graphed, at least WRa (LML) and WRa (LHH) have a folding point or a maximum point.

2. The electrophotographic photoreceptor of claim 1, wherein the tin oxide is included in the crosslinked surface layer in an amount of from 0.4 to 2.3 times that of the α-alumina by weight.

3. The electrophotographic photoreceptor of claim 1, wherein the crosslinked surface layer is formed with a coating liquid comprising a dispersant having an amine value not less than 4 mg KOH/g.

4. The electrophotographic photoreceptor of claim 1, wherein the crosslinked surface layer comprises an acrylate structural unit having an acryloyloxy group and a charge transportable structural unit.

5. A process cartridge for an image forming apparatus, comprising:

the electrophotographic photoreceptor according to claim 1; and an image forming unit comprising a solid lubricant applicator, comprising:

means for scraping off the solid lubricant with a brush-shaped roller and transferring the lubricant to the surface of the photoreceptor; and a blade for spreading the lubricant evenly on the surface of he photoreceptor.

6. An image forming apparatus, comprising:

the electrophotographic photoreceptor according to Claim 1;

a charger configured to charge the photoreceptor;

an irradiator configured to irradiate the photoreceptor to form an electrostatic latent image thereon;

an image developer configured to develop the electrostatic latent image with a toner to form a toner image;

a transferer configured to transfer the toner image onto a transfer medium;

a cleaner configured to remove the toner remaining on the photoreceptor after transferred;

a fixer configured to fix the toner image thereon; and a unit comprising a solid lubricant applicator, the unit comprising:

means for scraping off the solid lubricant with a brush-shaped roller and transferring the lubricant to the surface of the photoreceptor; and a blade for spreading the lubricant evenly on the surface of the photoreceptor.

* * * * *